US009032689B2

(12) United States Patent
Yustus et al.

(10) Patent No.: US 9,032,689 B2
(45) Date of Patent: May 19, 2015

(54) JACKING TOWER

(71) Applicant: Konecranes Plc, Hyvinkää (FI)

(72) Inventors: Joe Yustus, Hartford, WI (US); Marcus Jones, Phoenix, AZ (US)

(73) Assignee: Konecranes Plc, Hyvinkää (FI)

( * ) Notice: Subject to any disclaimer, the term of this patent is extended or adjusted under 35 U.S.C. 154(b) by 0 days.

(21) Appl. No.: 13/796,849

(22) Filed: Mar. 12, 2013

(65) Prior Publication Data

US 2014/0260076 A1 Sep. 18, 2014

(51) Int. Cl.

| | |
|---|---|
| ***E04B 1/00*** | (2006.01) |
| ***E04H 12/34*** | (2006.01) |
| ***E04H 12/10*** | (2006.01) |
| ***B66C 23/34*** | (2006.01) |

(52) U.S. Cl.

CPC ..... *E04H 12/344* (2013.01); *E04H 12/10* (2013.01); *B66C 23/348* (2013.01)

(58) Field of Classification Search

USPC ..... 52/745.18, 637, 123.1, 121

See application file for complete search history.

(56) References Cited

U.S. PATENT DOCUMENTS

| | | | | |
|---|---|---|---|---|
| 779,493 | A | 1/1905 | McMyler | |
| 1,360,131 | A * | 11/1920 | Miller | 52/123.1 |
| 1,644,499 | A * | 10/1927 | Trout | 52/123.1 |
| 2,676,388 | A | 4/1954 | Faure et al. | |
| 3,106,299 | A | 10/1963 | Pingon | |
| 3,127,996 | A | 4/1964 | Schwing | |
| 3,194,412 | A | 7/1965 | Kerridge | |
| 3,207,475 | A | 9/1965 | Johansson et al. | |
| 3,213,575 | A | 10/1965 | Boczek | |
| 3,466,723 | A | 9/1969 | Durand | |
| 3,656,631 | A | 4/1972 | Rauch et al. | |
| 3,894,635 | A | 7/1975 | Reich | |
| 3,998,029 | A | 12/1976 | James et al. | |
| 4,028,792 | A | 6/1977 | Tax et al. | |
| 4,196,814 | A | 4/1980 | Reich | |
| 4,205,826 | A | 6/1980 | Ten Broeke et al. | |
| 4,274,542 | A | 6/1981 | Barclay | |
| 4,524,873 | A | 6/1985 | McGowan | |
| 5,450,695 | A * | 9/1995 | Desai | 52/118 |

(Continued)

FOREIGN PATENT DOCUMENTS

| | | |
|---|---|---|
| DE | 1082022 | 5/1960 |
| DE | 3337911 | 5/1985 |
| GB | 1261585 | 1/1972 |

OTHER PUBLICATIONS

PCT/IB2014/000290 International Search Report and Written Opinion dated Jul. 15, 2014 (10 pages).

*Primary Examiner* — Basil Katcheves

(74) *Attorney, Agent, or Firm* — Michael Best & Friedrich LLP

(57) ABSTRACT

A method of self-erecting a jacking tower includes extending a lift assembly, inserting a first module assembly below the extended lift assembly, lowering the lift assembly around the first module assembly, engaging the lift assembly with the first module assembly, extending the lift assembly with the first module assembly engaged, inserting a second module assembly below the extended lift assembly, lowering the lift assembly, and coupling the first and second module assemblies.

7 Claims, 29 Drawing Sheets

(56) References Cited

U.S. PATENT DOCUMENTS 5,490,364 A * 2/1996 Desai et al. ..... 52/637
7,147,117 B2 12/2006 Davis et al.
7,290,672 B2 11/2007 Davis et al.
8,042,306 B2 * 10/2011 Jolly ..... 52/123.1
2003/0213765 A1 11/2003 St-Germain

* cited by examiner

JACKING TOWER

FIELD OF THE INVENTION

The present invention relates to a tower, and more particularly to a self-erecting jacking tower.

BACKGROUND OF THE INVENTION

Large-scale towers are known, and are used in the construction industry. The towers typically include a plurality of modular sections that are assembled and stacked vertically. The modular sections have frame-like structures, with the overall size of the modular sections generally decreasing toward the top of the tower. A boom or other structure is typically attached to the uppermost of the modular sections. Once assembled, the towers are used to raise and/or move components such as beams, trusses, etc. at a construction worksite.

SUMMARY

In accordance with one construction, a method of self-erecting a tower includes extending a lift assembly, inserting a first module assembly below the extended lift assembly, lowering the lift assembly around the first module assembly, engaging the lift assembly with the first module assembly, extending the lift assembly with the first module assembly engaged, inserting a second module assembly below the extended lift assembly, lowering the lift assembly, and coupling the first and second module assemblies.

In accordance with another construction, a method of self-erecting a tower includes delivering a top module assembly to a scissors lift assembly, the top module assembly including an outer frame and an inner frame movable within the outer frame. The method further includes raising the top module assembly with the scissors lift assembly, and delivering a middle module assembly below the raised top module assembly. The middle module assembly includes an outer frame and an inner frame movable within the outer frame. The method further includes coupling the top module assembly to the middle module assembly, and raising the middle module assembly and top module assembly together with the scissors lift assembly. The method further includes delivering a bottom module assembly below middle module assembly and the top module assembly, the bottom module assembly including an outer frame and an inner frame movable within the outer frame. The method further includes coupling the middle module assembly to the bottom module assembly.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
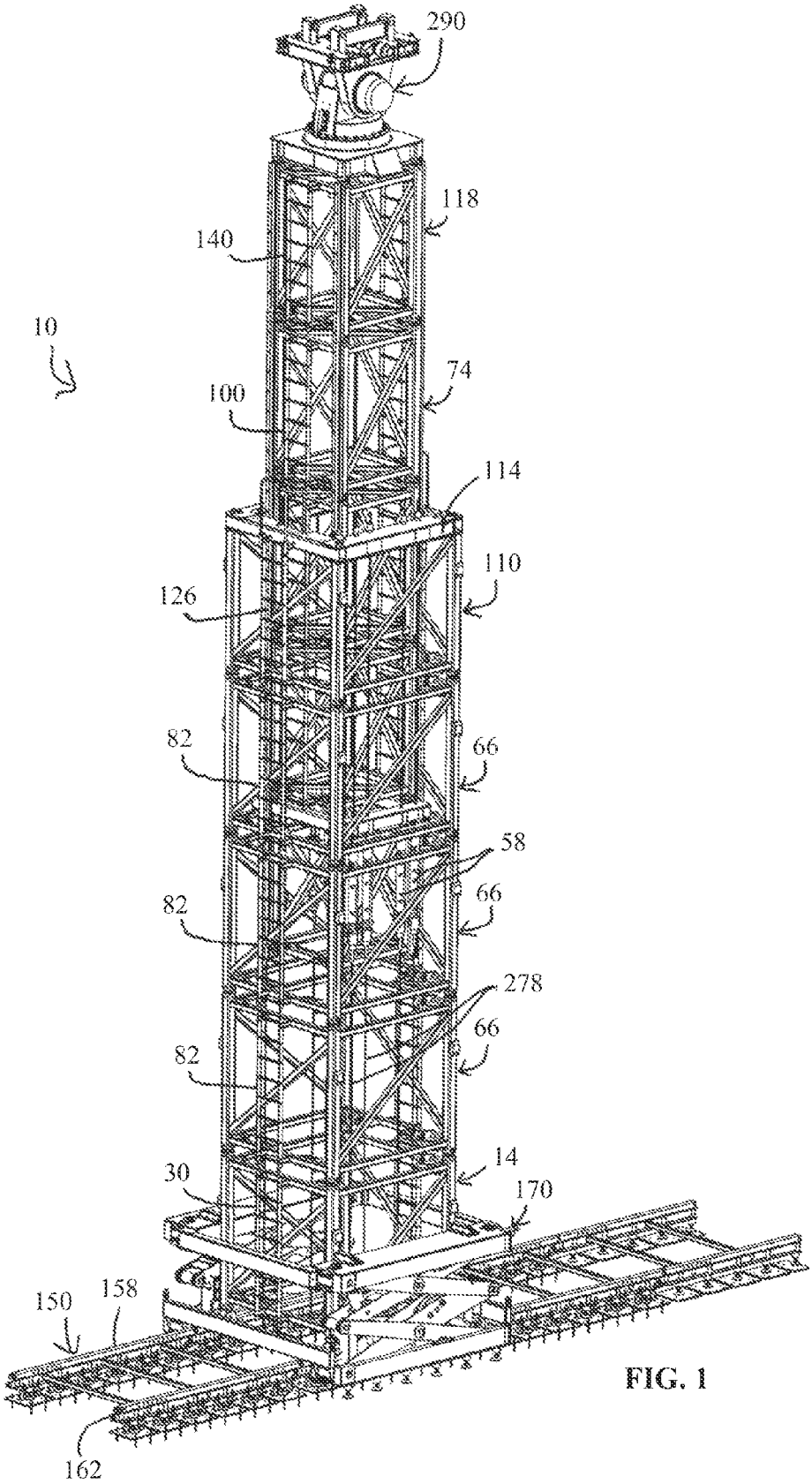
FIG. 1 is a perspective view of a fully assembled self-erecting jacking tower according to one construction of the invention.
Figure 2:
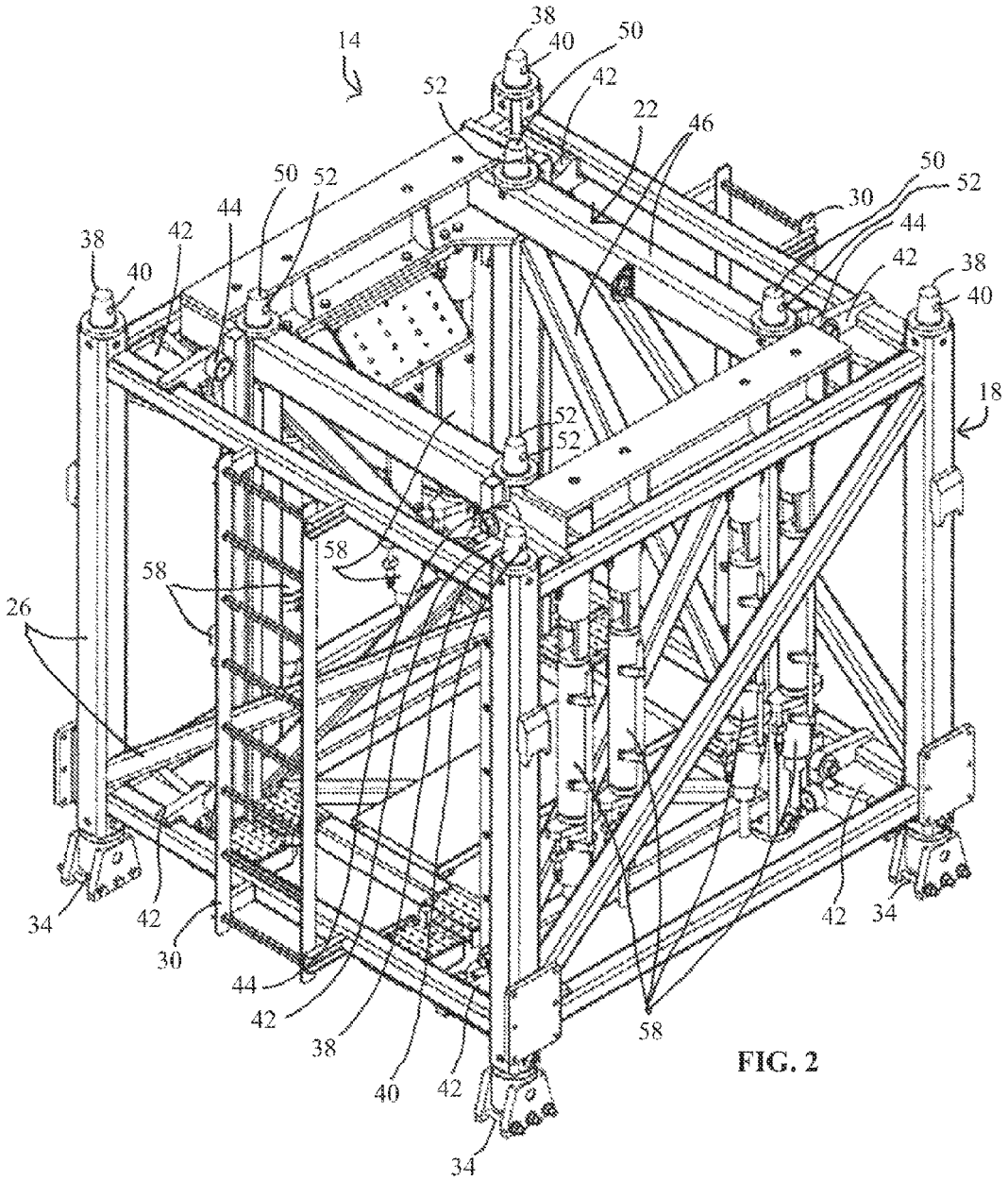
FIG. 2 is a top perspective view of a bottom module assembly of the self-erecting jacking tower of FIG. 1.
Figure 3:
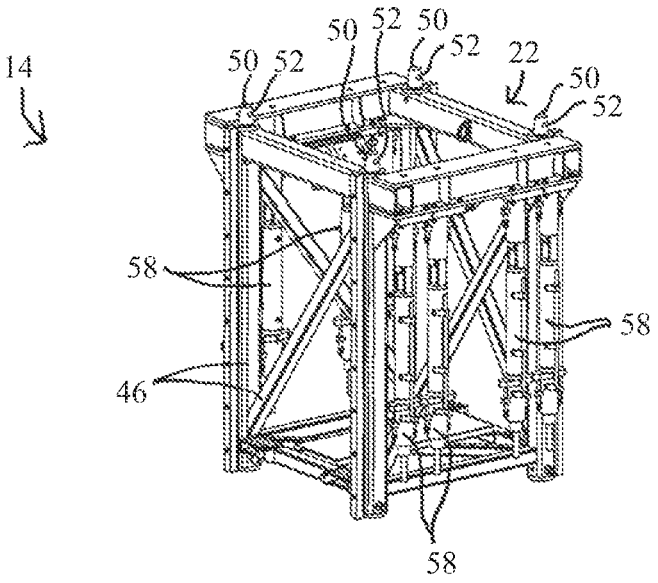
FIG. 3 is a top perspective exploded view of the bottom module assembly of FIG. 2, illustrating an outer frame and an inner frame of the bottom module assembly.
Figure 3:
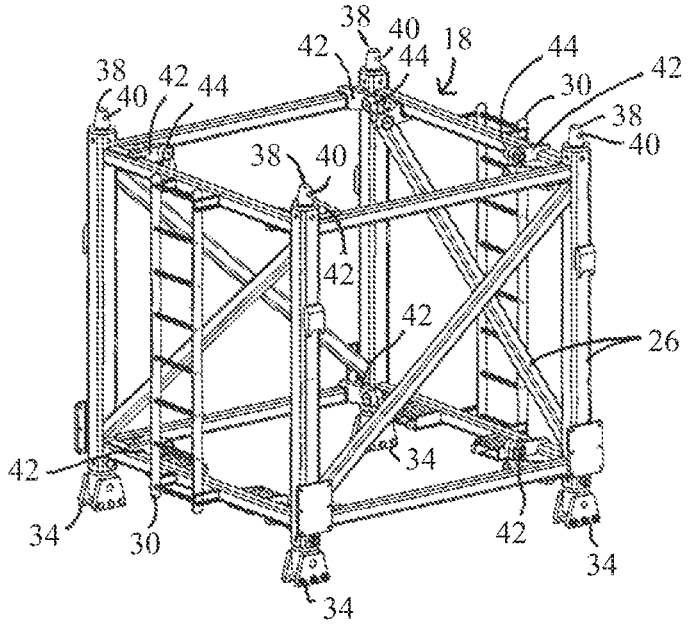

FIG. 1 illustrates a fully assembled self-erecting jacking tower 10. Among other uses, the jacking tower 10 is used to install overhead cranes in industrial commercial, and nuclear power plants.

With reference to FIGS. 1-4 the jacking tower 10 includes a lower module assembly 14. The lower module assembly 14 serves as a base for the jacking tower 10, and is the lowest module assembly on the jacking tower 10.

The lower module assembly 14 includes an outer frame 18 and an inner frame 22, the inner frame 22 being movable relative the outer frame 18. The outer frame 18 includes structural beams 26 that are coupled together (e.g. welded or fastened) to form a generally box-like structure. The outer frame 18 also includes two ladder assemblies 30 disposed opposite one another along the outer frame 18. The ladder assemblies 30 are used by a tower operator, for example, to climb from the lower module assembly 14 to other assemblies on the jacking tower 10. While two ladder assemblies 30 are illustrated, other constructions include different numbers of ladder assemblies 30, and different locations for the ladder assemblies 30. The outer frame 18 also includes four feet 34. The feet 34 are positioned along a bottom of the outer frame 18, and at corners of the outer frame 18. The feet 34 provide stability for the outer frame 18. While four feet 34 are illustrated, other constructions include different numbers of feet 34, and different locations for the feet 34.

With continued reference to FIGS. 1-4, the outer frame 18 also includes four male mating components 38. The male mating components 38 are used to couple the outer frame 18 to other assemblies of the jacking tower 10. The male mating components 38 are positioned along a top of the outer frame 18, and at corners of the outer frame 18. The male mating components 38 are positioned directly above the feet 34. The male mating components 38 are in the form of tapered pins with apertures 40 for receiving bolts, though other shapes and forms are also possible. While four male mating components 38 are illustrated, other constructions include different numbers of male mating components 38. In some constructions, the outer frame 18 includes female mating components instead of male mating components 38.

The outer frame 18 also includes eight guides 42. The guides 42 are positioned along a top of the outer frame 18, and generally adjacent the four male mating components 38. The guides 42 engage with the inner frame 22, and include rollers 44. The guides 42 guide movement of the inner frame 22 relative to the outer frame 18. While eight guides 42 are illustrated, other constructions include different numbers of guides 42, and different locations for the guides 42.

With continued reference to FIGS. 1-4, the inner frame 22 includes structural beams 46 that are coupled together (e.g. welded or fastened) to form a generally box-like structure. The inner frame 22 includes four male mating components 50. The male mating components 50 are used to couple the inner frame 18 to other assemblies of the jacking tower 10. The male mating components 50 are in the form of tapered pins with apertures 52 for receiving bolts, though other shapes and forms are also possible. The male mating components 50 are positioned along a top of the inner frame 22, and at corners of the inner frame 22. While four male mating components 50 are illustrated, other constructions include different numbers of male mating components 50, and different locations for the male mating components 50.

Figure 4:
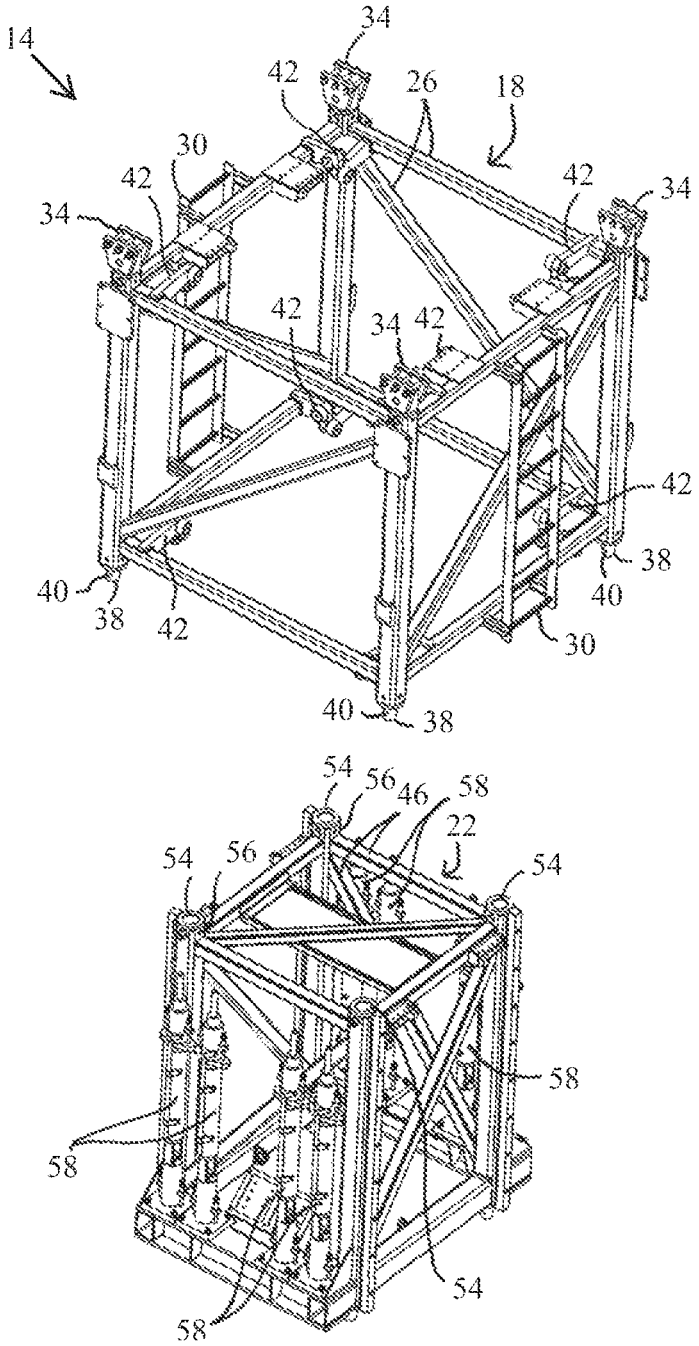
FIG. 4 is a bottom perspective exploded view of the bottom module assembly of FIG. 2

With reference to FIG. 4, the inner frame 22 also includes four female mating components 54. The female mating components 54 are in the form of tapered sockets with apertures 56 for receiving bolts, though other shapes and forms are also possible. The female mating components 54 are positioned along a bottom of the inner frame 22, and at corners of the inner frame 22. While four female mating components 54 are illustrated, other constructions include different numbers of female mating components 54, and different locations for the female mating components 54.

Figure 5:
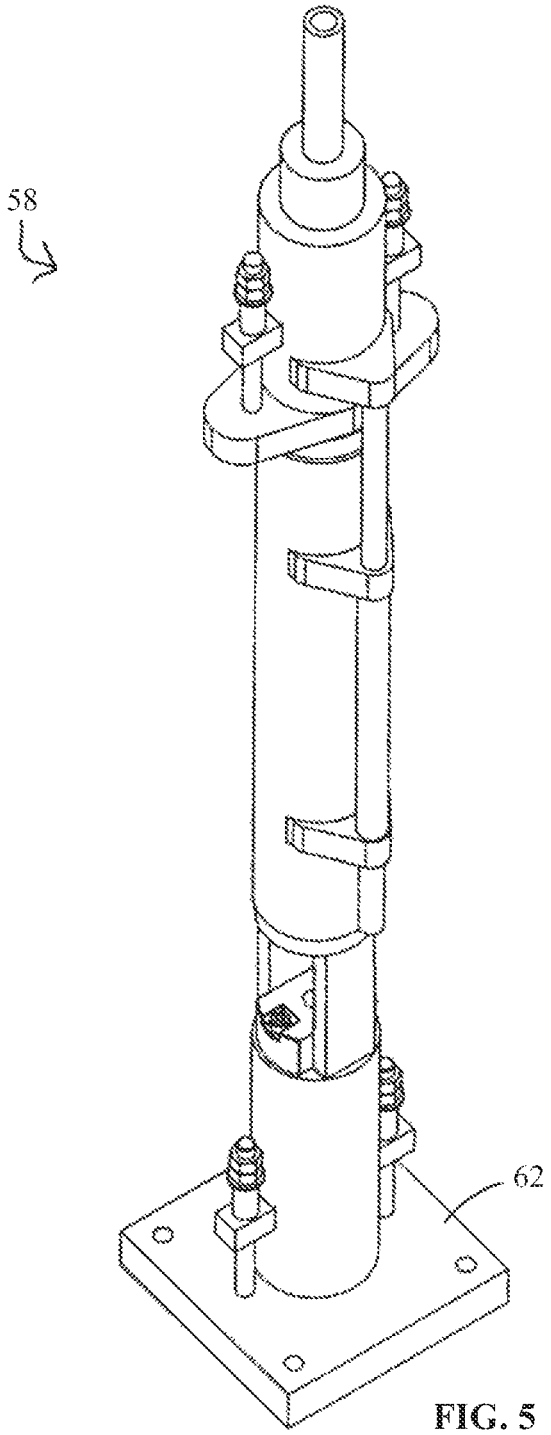
FIG. 5 is a perspective view of a strand jack assembly of the self-erecting jacking tower of FIG. 1.

With reference to FIGS. 1-5, the inner frame 22 also includes eight strand jacks 58. As described further herein, the strand jacks 58 are used to raise and lower one or more inner frames (e.g. inner frame 22) relative to one or more outer frames (e.g. outer frame 18). The strand jacks 58 are disposed in inverted positions in the inner frame 22. In the illustrated construction, four strand jacks are located on one side of the inner frame 22, and the other four strand jacks 58 are located on an opposite side of the inner frame 22. The strand jacks 58 are powered hydraulically. With reference to FIG. 5, the strand jacks 58 include mounting platforms 62 that are used to mount the strand jacks 58 to the inner frame 22. While eight strand jacks 58 are illustrated, other constructions include different numbers of strand jacks 58, and different locations for the strand jacks 58.

With reference to FIGS. 1 and 6-8, the jacking tower 10 includes middle module assemblies 66. The middle module assemblies 66 are located above the lower module assembly 14.

The middle module assemblies 66 each include an outer frame 70 and an inner frame 74, the inner frame 74 being movable relative the outer frame 70. The outer frame 70 includes structural beams 78 that are coupled together (e.g. welded or fastened) to form a generally box-like structure. The outer frame 70 also includes two ladder assemblies 82 disposed opposite one another along the outer frame 70. The ladder assemblies 82 are used by a tower operator, for example, to climb from the middle module assemblies 66 to other assemblies on the jacking tower 10, including the lower module assembly 14. As illustrated in FIG. 1, the ladder assemblies 82 are aligned with the ladder assemblies 30 of the lower module assembly 14. While two ladder assemblies 82 are illustrated, other constructions include different numbers of ladder assemblies 82, and different locations for the ladder assemblies 82.

With continued reference to FIGS. 1 and 6-8, the outer frame 70 also includes four male mating components 86. The male mating components 86 are used to couple the outer frame 70 to other assemblies of the jacking tower 10, including other middle module assemblies 66. The male mating components 86 are positioned along a top of the outer frame 70, and at corners of the outer frame 70. The male mating components 86 are in the form of tapered pins with apertures 88 for receiving bolts, though other shapes and forms are also possible. While four male mating components 86 are illustrated, other constructions include different numbers of male mating components 86.

Figure 8:
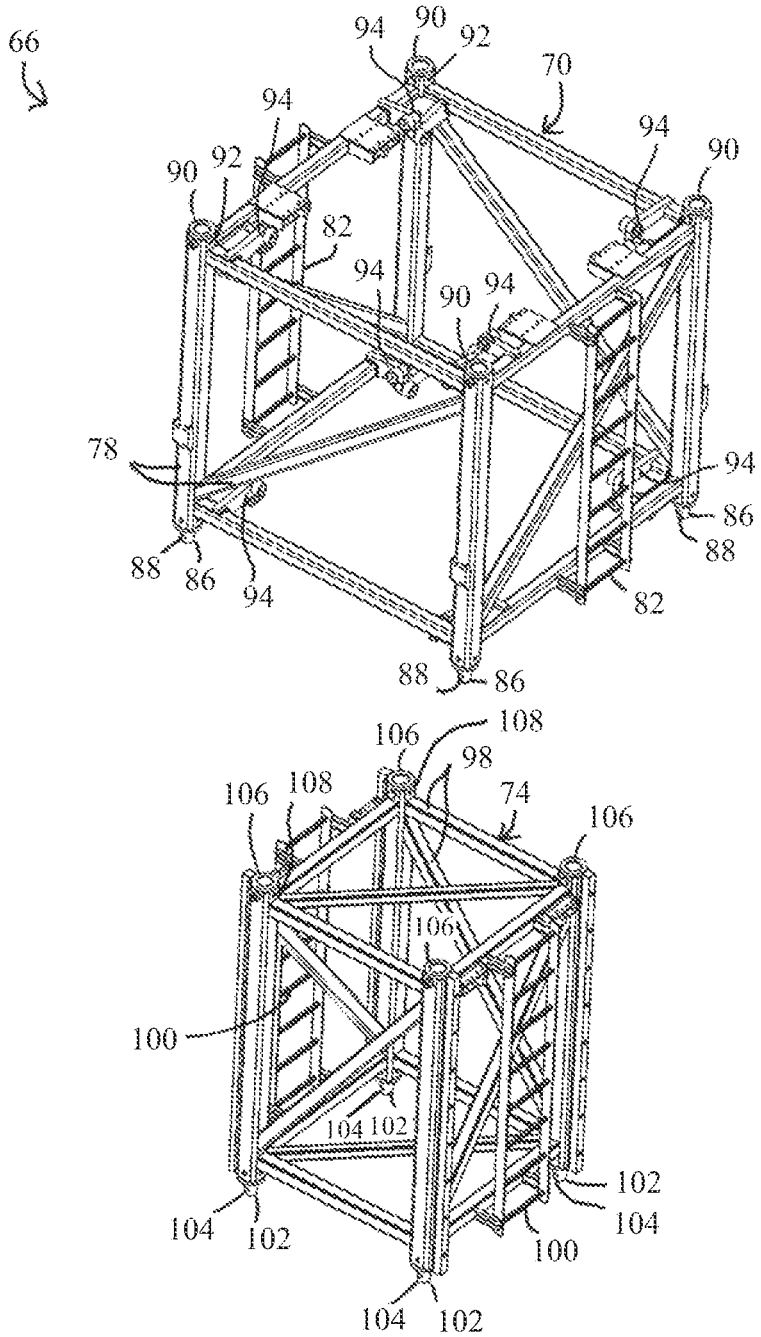
FIG. 8 is a bottom perspective exploded view of the middle module assembly of FIG. 6.

With reference to FIG. 8, the outer frame 70 also includes four female mating components 90. The female mating components 90 are in the form of tapered sockets, though other shapes and forms are also possible. The female mating components 90 are positioned along a bottom of the outer frame 70, and at corners of the outer frame 70. The female mating components 90 are in the form of tapered sockets, with apertures 92 for receiving bolts. The female mating components 90 are configured to receive the male mating components 86 of another middle module assembly 66, or the male mating components 38 of the lower module assembly 14, so as to couple the outer frame 70 of the middle module assembly 66 to another outer frame 70 of a different middle module assembly 66, or to the outer frame 18 of the lower module assembly 14. While four female mating components 90 are illustrated, other constructions include different numbers of female mating components 90, and different locations for the female mating components 90.

Figure 6:
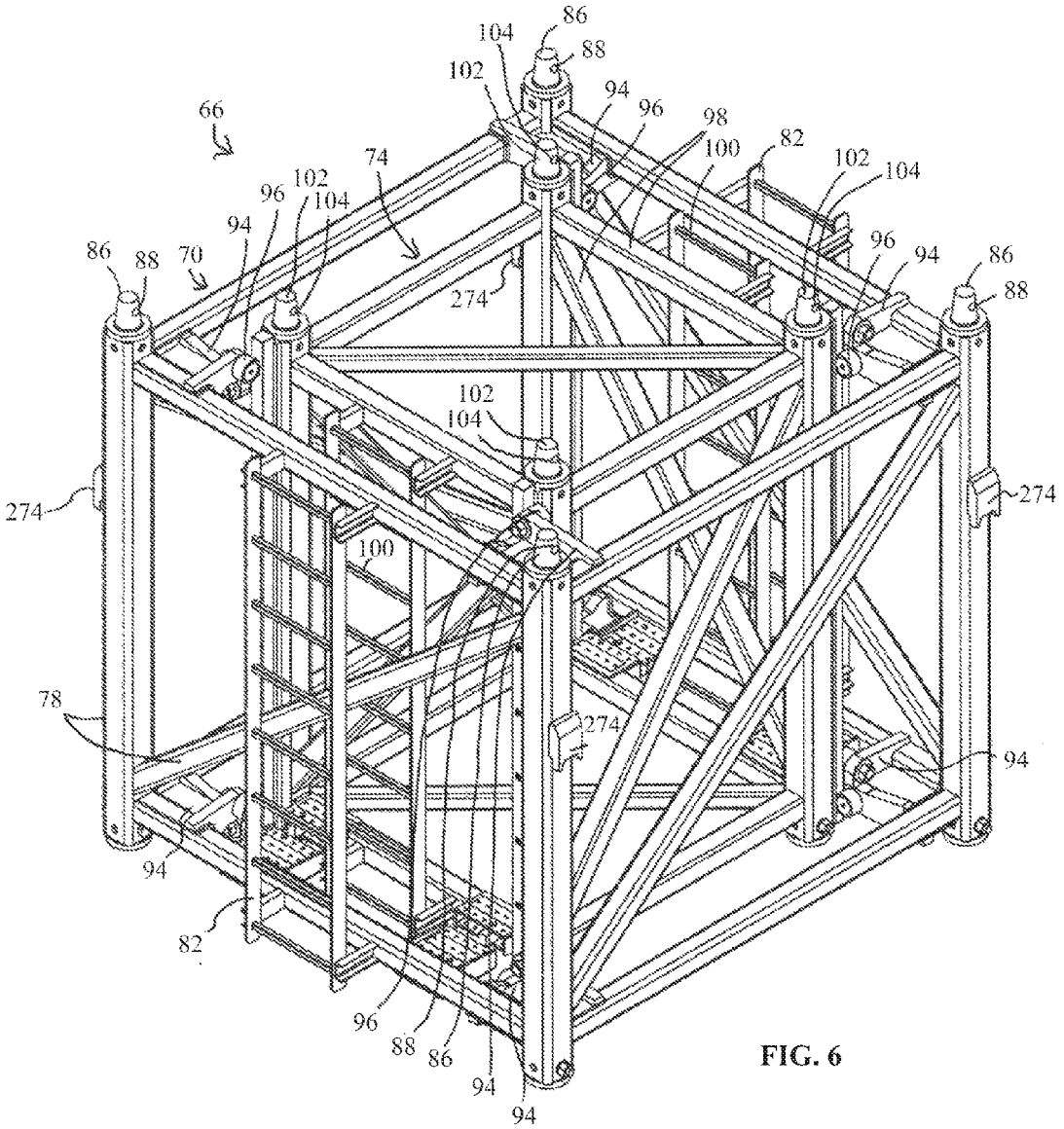
FIG. 6 is a top perspective view of a middle module assembly of the self-erected jacking tower of FIG. 1.
Figure 7:
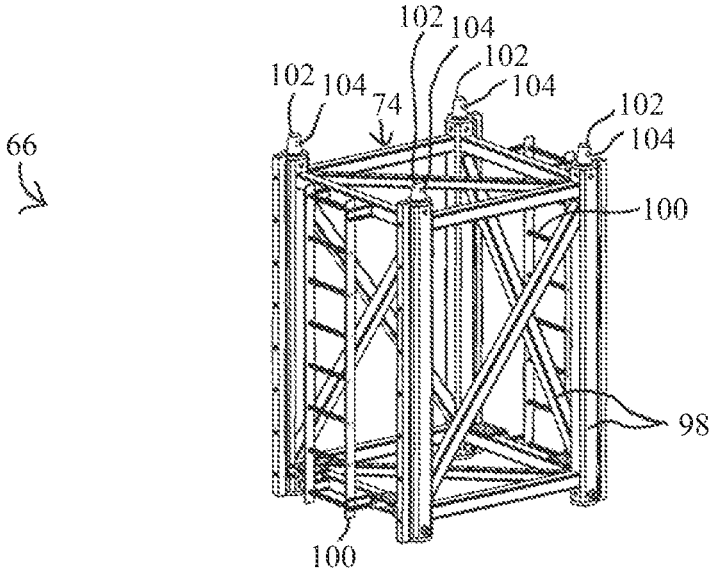
FIG. 7 is a top perspective exploded view of the middle module assembly of FIG. 6, illustrating an outer frame and an inner frame of the middle module assembly.
Figure 7:
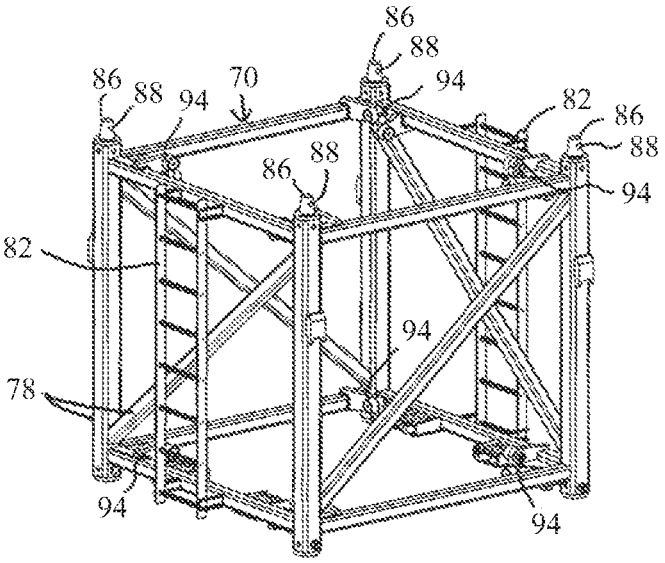

The outer frame 70 also includes eight guides 94 (FIG. 6). The guides 94 are positioned along a top of the outer frame 70, and each is positioned generally adjacent one of the male mating components 86. The guides 94 engage with the inner frame 74, and include rollers 96. The guides 94 guide movement of the inner frame 74 relative to the outer frame 70. While eight guides 94 are illustrated, other constructions include different numbers of guides 94, and different locations for the guides 94.

With continued reference to FIGS. 1 and 6-8, the inner frame 74 includes structural beams 98 that are coupled together (e.g. welded or fastened) to form a generally box-like structure. The inner frame 74 includes ladder assemblies 100 located on opposite sides of the inner frame 74. The ladder assemblies 100 are used by a tower operator, for example, to climb along the inner frames 74 of the middle module assemblies 66. While two ladder assemblies 100 are illustrated, other constructions include different numbers of ladder assemblies 100, and different locations for the ladder assemblies 100.

The inner frame 74 also includes four male mating components 102. The male mating components 102 are used to couple the inner frame 74 to other assemblies of the jacking tower 10, including other middle module assemblies 66. The male mating components 102 are positioned along a top of the inner frame 74 and at corners of the inner frame 74. The male mating components 102 are in the form of tapered pins with apertures 104 for receiving bolts, though other shapes and forms are also possible. While four male mating components 102 are illustrated, other constructions include different numbers of male mating components 102, and different locations for the male mating components 102.

With reference to FIG. 8, the inner frame 74 also includes four female mating components 106. The female mating components 106 are in the form of tapered sockets with apertures 108 for receiving bolts, though other shapes and forms are also possible. The female mating components 106 are positioned along a bottom of the inner frame 74, and at corners of the inner frame 74. The female mating components 106 are configured to receive the male mating components 102 of another middle module assembly 66, or the male mating components 50 of the lower module assembly 14, so as to couple the inner frame 74 of the middle module assembly 66 to another inner frame 74 of a different middle module assembly 66, or to the inner frame 22 of the lower module assembly 14. While four female mating components 106 are illustrated, other constructions include different numbers of female mating components 106, and different locations for the female mating components 106.

With reference to FIGS. 1 and 9-11, the jacking tower 10 includes a top module assembly 110. The top module assembly 110 is located above middle module assemblies 66 and the lower module assembly 14.

The top module assembly 110 includes an outer frame 114 and an inner frame 118, the inner frame 118 being movable relative the outer frame 114. The outer frame 114 includes structural beams 122 that are coupled together (e.g. welded or fastened) to form a generally box-like structure. The outer frame 114 also includes two ladder assemblies 126 disposed opposite one another along the outer frame 114. The ladder assemblies 126 are used by a tower operator, for example, to climb from the top module assembly 110 to other assemblies on the jacking tower 10, including the middle module assemblies 66 and the lower module assembly 14. As illustrated in FIG. 1, the ladder assemblies 126 are aligned with the ladder assemblies 82 of the middle module assemblies 66 and the ladder assemblies 30 of the lower module assembly 14. While two ladder assemblies 126 are illustrated, other constructions include different numbers of ladder assemblies 126, and different locations for the ladder assemblies 126.

Figure 11:
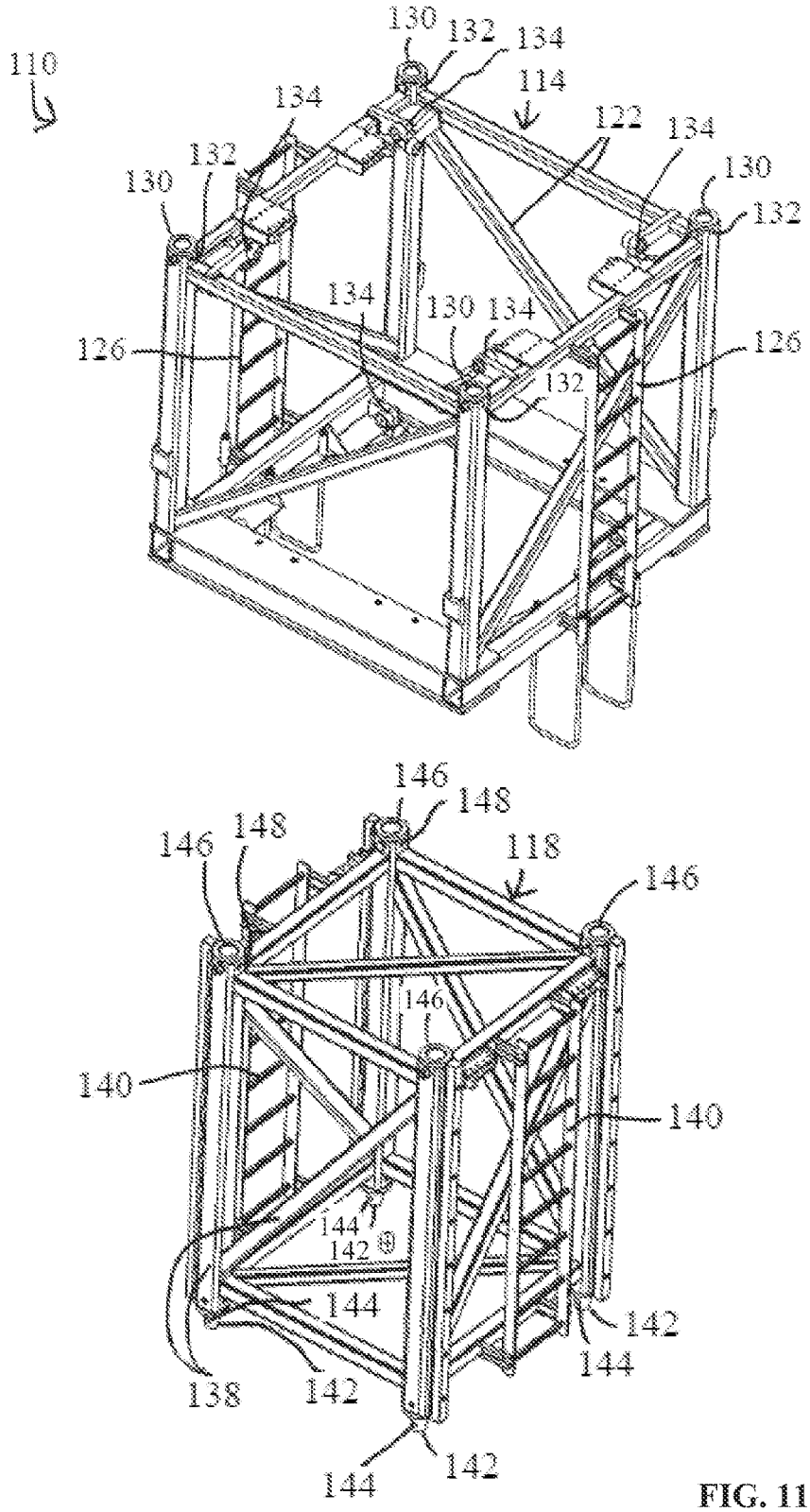
FIG. 11 is a bottom perspective exploded view of the top module assembly of FIG. 9.

With reference to FIG. 11, the outer frame 114 includes four female mating components 130. The female mating components 130 are in the form of tapered sockets with apertures 132 for receiving bolts, though other shapes and forms are also possible. The female mating components 130 are positioned along a bottom of the outer frame 114, and at corners of the outer frame 114. The female mating components 130 are configured to receive the male mating components 86 of a middle module assembly 66, so as to couple the outer frame 114 of the top module assembly 66 to the outer frame 70 of a middle module assembly 66. While four female mating components 130 are illustrated, other constructions include different numbers of female mating components 130, and different locations for the female mating components 130.

The outer frame 114 also includes eight guides 134. The guides 134 are positioned along a top of the outer frame 114. The guides 134 are engaged with the inner frame 118, and include rollers 136. The guides 134 guide movement of the inner frame 118 relative to the outer frame 114. While eight guides 134 are illustrated, other constructions include different numbers of guides 134 or sets of guides 134, and different locations for the guides 134 or sets of guides 134.

With continued reference to FIGS. 1 and 9-11, the inner frame 118 includes structural beams 138 that are coupled together (e.g. welded or fastened) to form a generally box-like structure. The inner frame 118 includes ladder assemblies 140 located on opposite sides of the inner frame 118. The ladder assemblies 140 are used by a tower operator, for example, to climb between the top module assembly 110 and the middle module assemblies 66. While two ladder assemblies 140 are illustrated, other constructions include different numbers of ladder assemblies 140, and different locations for the ladder assemblies 140.

The inner frame 138 also includes four male mating components 142. The male mating components 142 are used to couple the inner frame 118 to other assemblies of the jacking tower 10, including a head assembly as described further herein. The male mating components 142 are positioned along a top of the inner frame 118 and at corners of the inner frame 118. The male mating components 142 are in the form of tapered pins with apertures 144 for receiving bolts, though other forms and shapes are also possible. While four male mating components 142 are illustrated, other constructions include different numbers of male mating components 142, and different locations for the male mating components 142.

With reference to FIG. 11, the inner frame 118 also includes four female mating components 146. The female mating components 146 are in the form of tapered sockets with apertures 148 for receiving bolts, though other shapes and forms are also possible. The female mating components 146 are positioned along a bottom of the inner frame 118, and at corners of the inner frame 118. The female mating components 146 are configured to receive the male mating components 102 of a middle module assembly 66, so as to couple the inner frame 118 of the top module assembly 66 to an inner frame 74 of a middle module assembly 66. While four female mating components 146 are illustrated, other constructions include different numbers of female mating components 146, and different locations for the female mating components 146.

Figure 12:
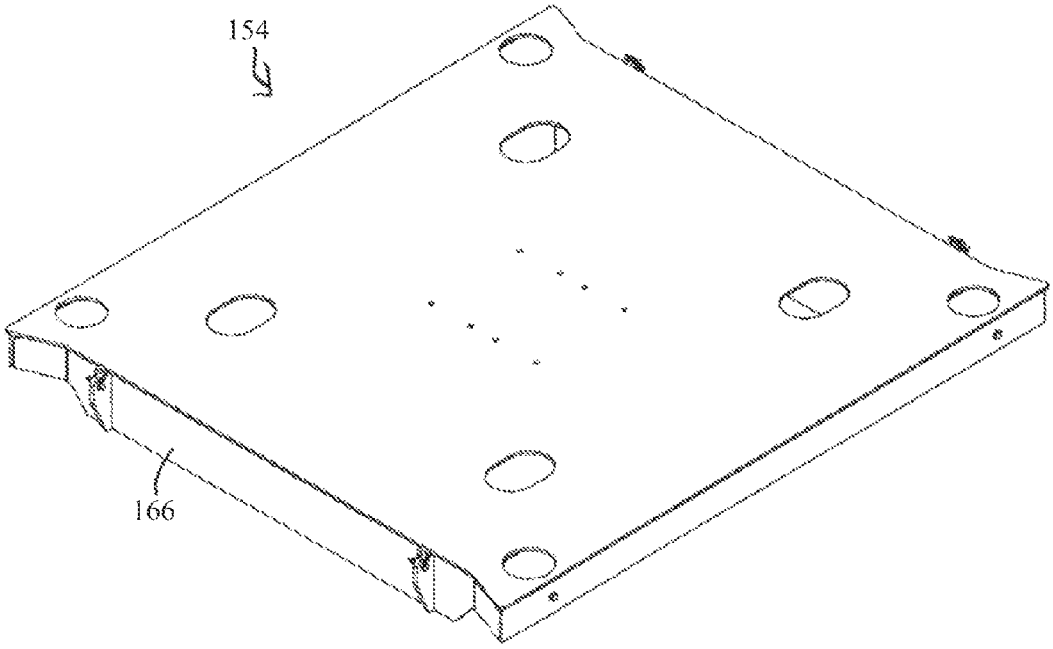
FIG. 12 is a perspective view of a rail cart for transporting one or more of a bottom, middle, and top module assembly.

With reference to FIGS. 1 and 12, the jacking tower 10 further includes a rail assembly 150 and a rail cart 154. The rail assembly 150 is positioned along a surface (e.g. the floor of an industrial, commercial, and/or nuclear power plant). The rail assembly 150 includes rails 158, 162. The rail cart 154 is configured to move along the rails 158, 162. The rail cart 150 includes rigid track dollies 166, integrated into the rail cart 150. As described further herein, the rail cart 154 carries pieces of the jacking tower 10, including the lower module assembly 14, middle module assemblies 66, and top module assembly 110, from a staging area to a jacking tower erection site.

With reference to FIGS. 1 and 13-22, the jacking tower 10 further includes a lift assembly 170. The lift assembly 170 is illustrated as a scissors lift assembly 170, though other constructions utilize lift assemblies other than scissors lift assemblies. As illustrated in FIG. 1, the scissors lift assembly 170 is positioned along the rail assembly 150, such that the scissors lift assembly 170 straddles the rail assembly 150. The lift assembly 170 includes levelers 172 that consist of leveling pads and elevator bolts. The lift assembly 170 includes a top frame 174, a bottom frame 178, and two scissors assemblies 180, each having movable scissors elements 182 linked together and disposed between the top frame 174 and bottom frame 178. The scissor elements 182 are coupled with pivot pins 184. The scissors elements 182 are coupled to the top frame 174 and the bottom frame 178.

Figure 13:
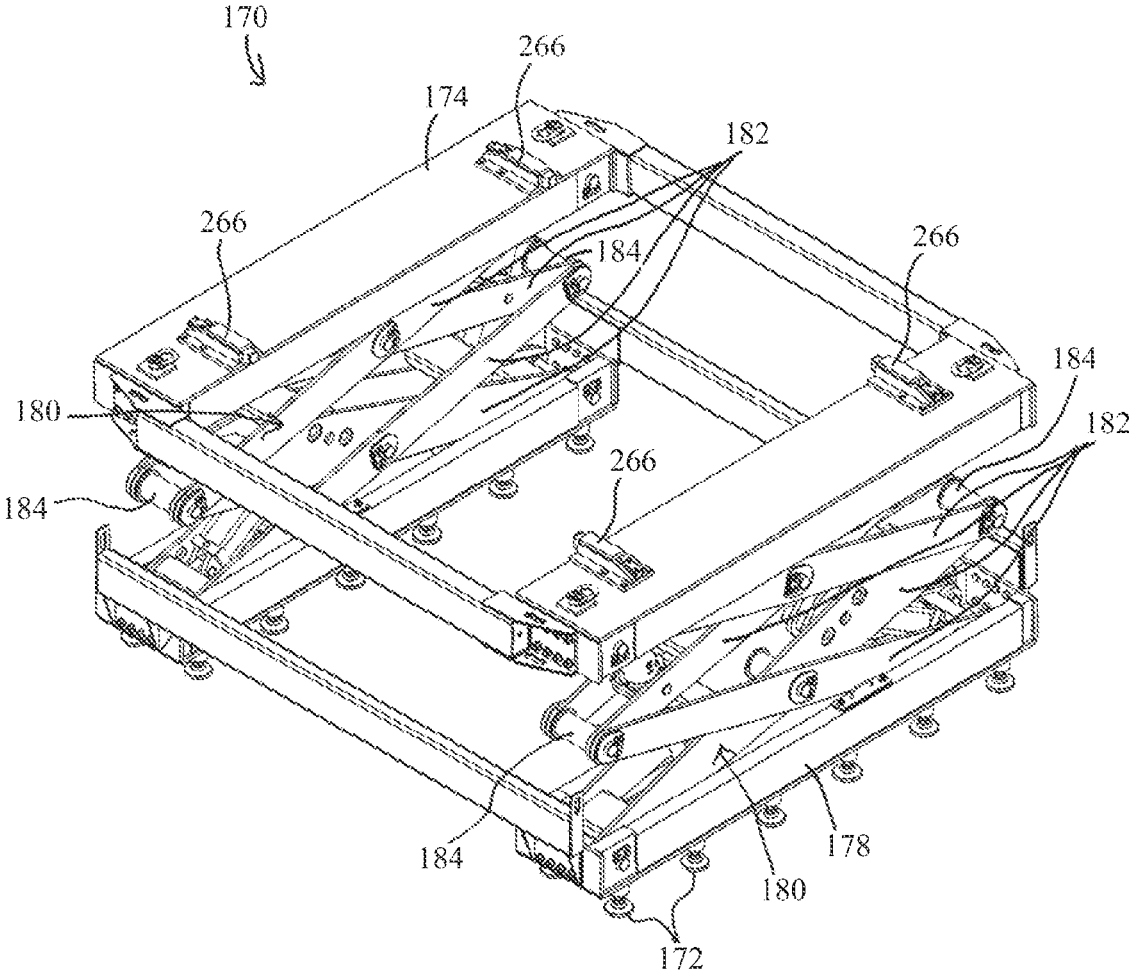
FIG. 13 is a top perspective view of a lift assembly for raising one or more of a bottom, middle, and top module assembly, the lift assembly in a retracted state.
Figure 14:
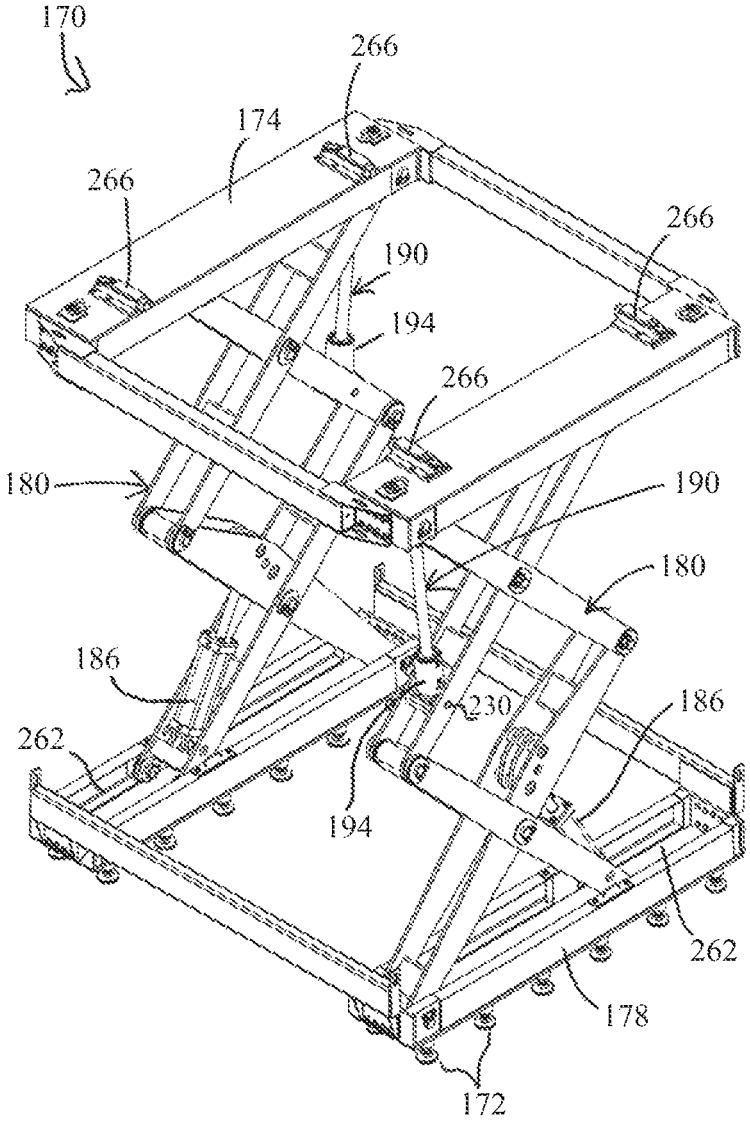
FIG. 14 is a top perspective view of the lift assembly of FIG. 13, the scissors lift assembly in an extended state.
Figure 15:
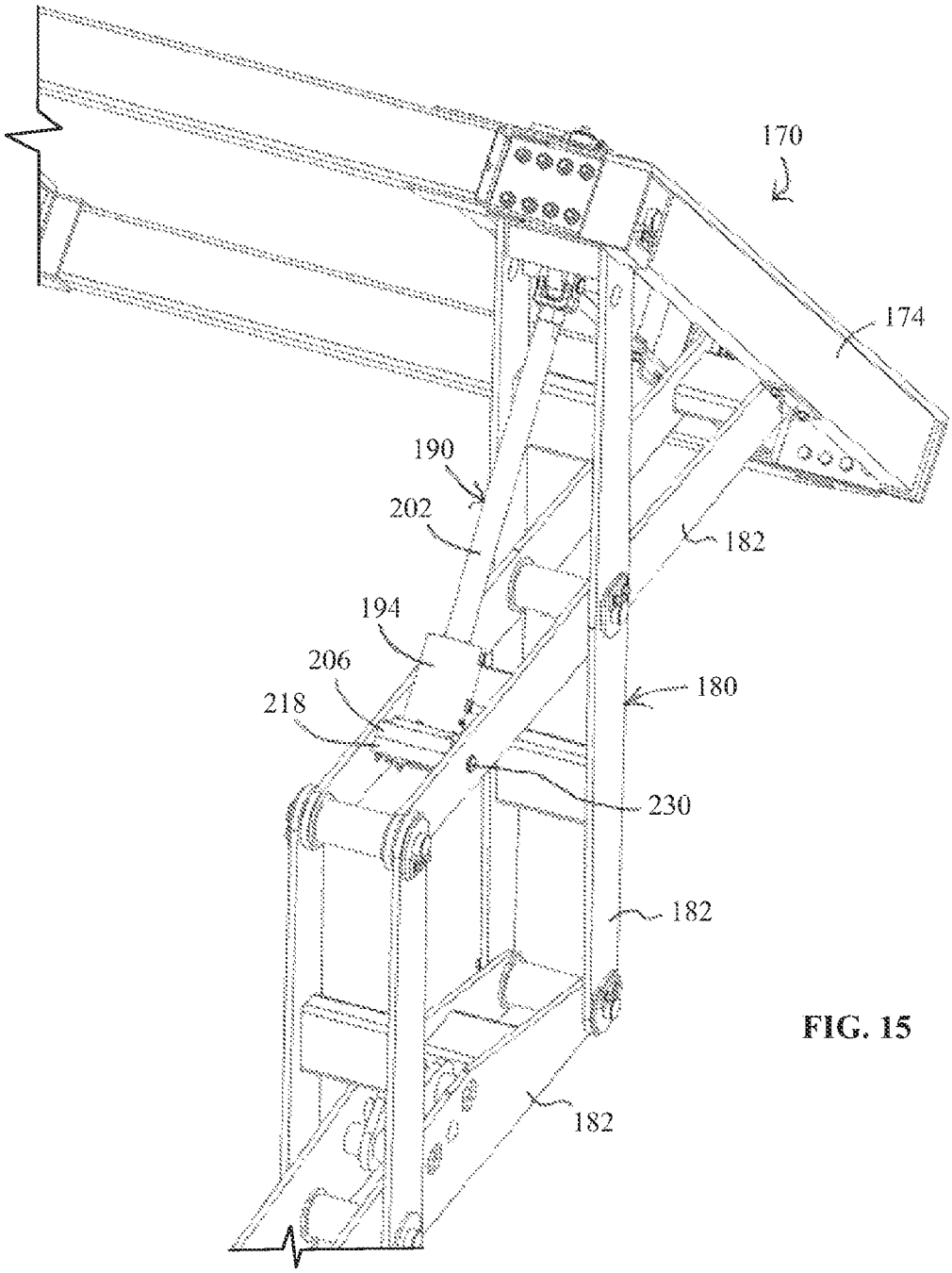
FIG. 15 is a partial, enlarged view of the extended lift assembly of FIG. 13, illustrating a safety catch mechanism.

The lift assembly 170 also includes two hydraulic cylinders 186. The hydraulic cylinders 186 are coupled to a pair of scissors elements 182. The hydraulic cylinders 186 are actuatable to raise the top frame 174 relative to the bottom frame 178. Specifically, the hydraulic cylinders 186 cause the scissors lift assembly 170 to move from a lowered, retracted position as illustrated in FIG. 13, to a raised, extended position as illustrated in FIG. 14. While two hydraulic cylinders 186 are illustrated, other constructions include different numbers of hydraulic cylinders 186, and different locations for the hydraulic cylinders 186.

The lift assembly 170 also includes two safety catch mechanisms 190. The safety catch mechanisms 190 are coupled to at least one of the top frame 174, bottom frame 178, and the movable scissor elements 182. In the illustrated construction, the safety catch mechanisms 190 are coupled to a pair of movable scissors elements 182. The safety catch mechanisms 190 prevent the lift assembly 170 from collapsing at a load that would damage the lift assembly 170. Specifically, the safety catch mechanism 190 stops downward movement of the top frame 174 relative to the bottom frame 178. The safety catch mechanisms 190 are configured to stop downward movement of the top frame 174 relative to the bottom frame 178 in the event the hydraulic cylinders 186 fail. While two safety catch mechanisms 190 are illustrated, other constructions include different numbers of safety catch mechanisms 190, and different locations for the safety catch mechanisms 190.

The safety catch mechanism 190 includes a first housing 194 having an aperture 198 extending entirely through the first housing 194. The first housing 194 is an elongate cylinder. The safety catch mechanism 190 also includes an elongate rod 202 extending into and through the first aperture 198. A second housing 206 is disposed below the first housing 194, the second housing 206 including an aperture 210 extending entirely through the second housing 206, and two grooves 214. The safety catch mechanism 190 also includes a third housing 218 disposed below the second housing 206. The third housing 218 includes an aperture 222 extending entirely through the third housing 218, and two grooves 226, each of which is aligned with a groove 214 of the second housing 206 when the safety catch mechanism is assembled. Trunnions 230 are disposed in each pair of second housing grooves 214 and third housing grooves 226, and the trunnions 230 are engaged with one of the scissor elements 182. The trunnions 230 permit rotational movement of the first housing 194, second housing 206, and third housing 218 relative to the scissors elements 182.

Figure 16:
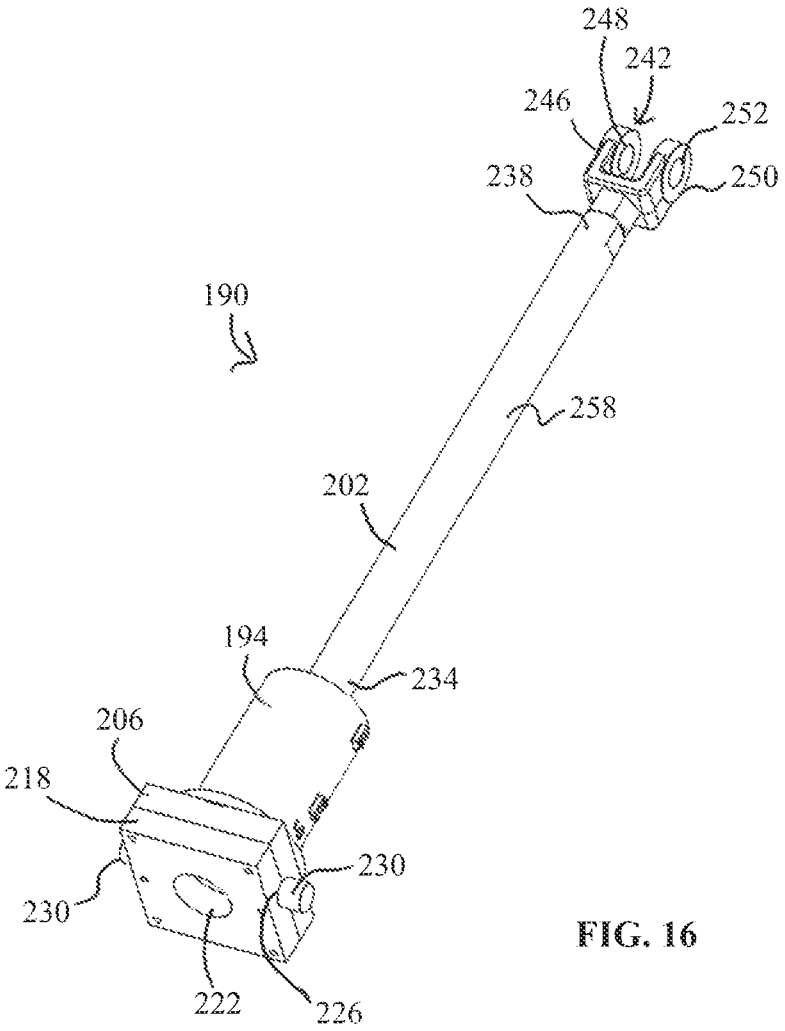
FIG. 16 is a bottom perspective view of the safety catch mechanism of FIG. 14.
Figure 17:
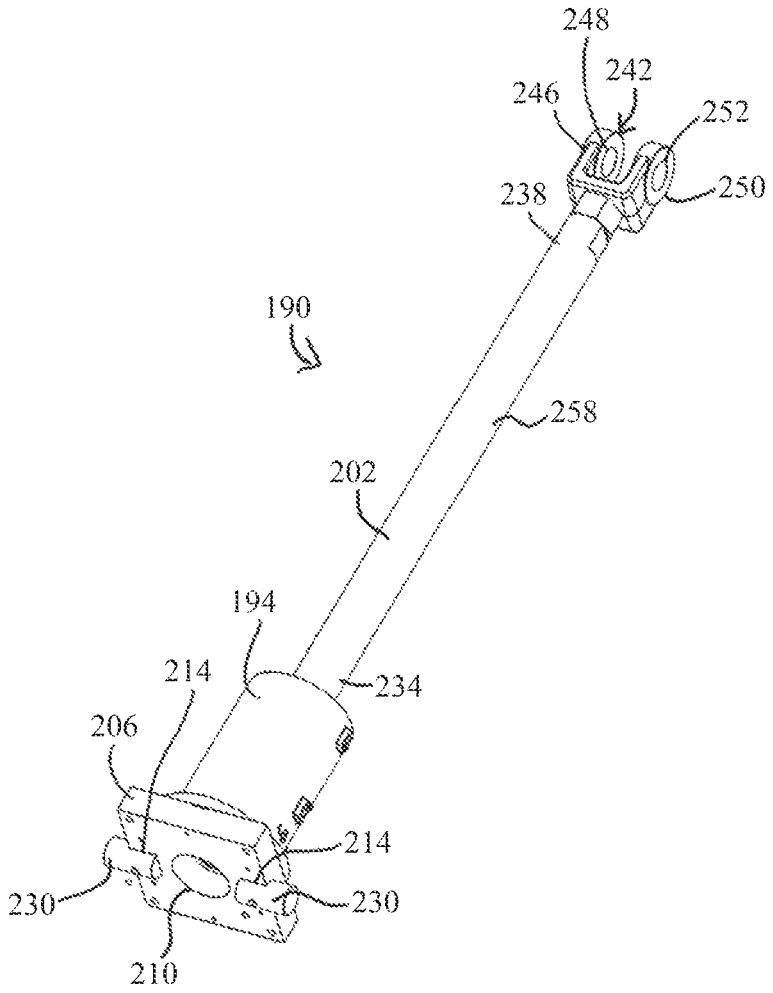
FIG. 17 is a bottom perspective view of the safety catch mechanism of FIG. 14, with a housing removed.
Figure 18:
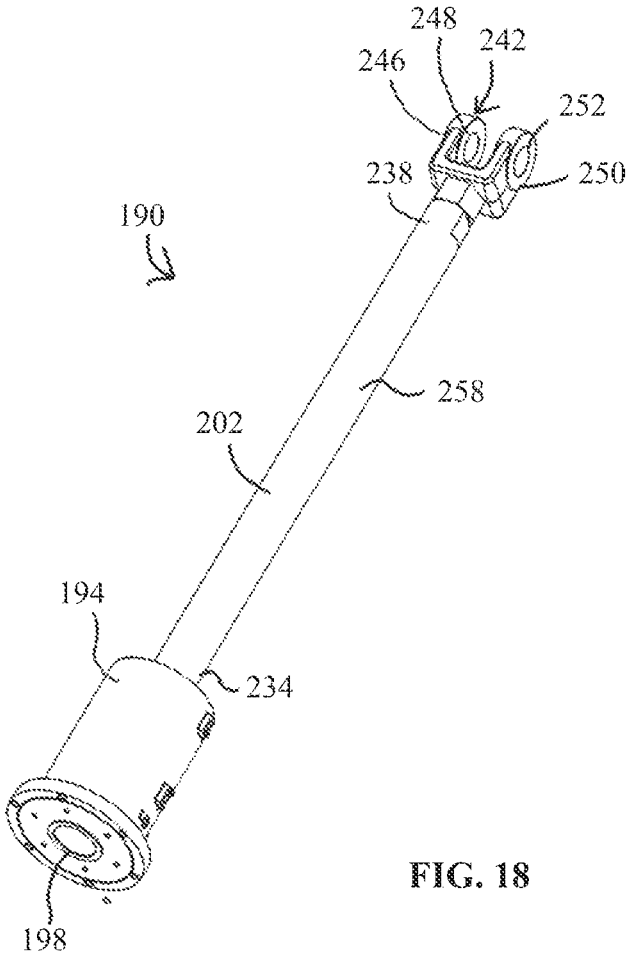
FIG. 18 is a bottom perspective view of the safety catch mechanism of FIG. 14, with a housings and trunnions removed.
Figure 19:
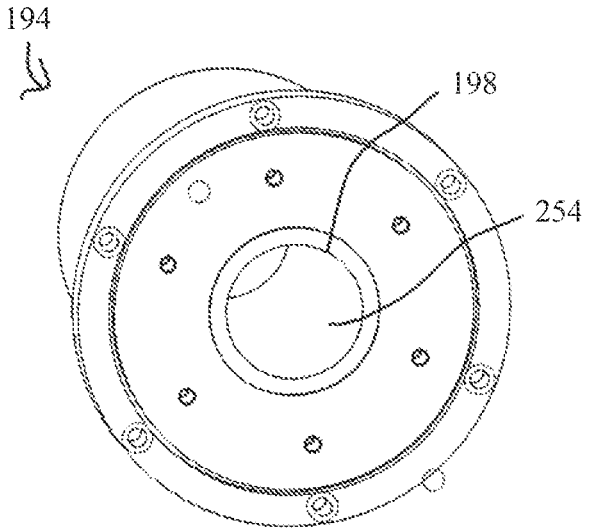
FIG. 19 is a bottom perspective view of a housing of the safety catch mechanism of FIG. 14.
Figure 20:
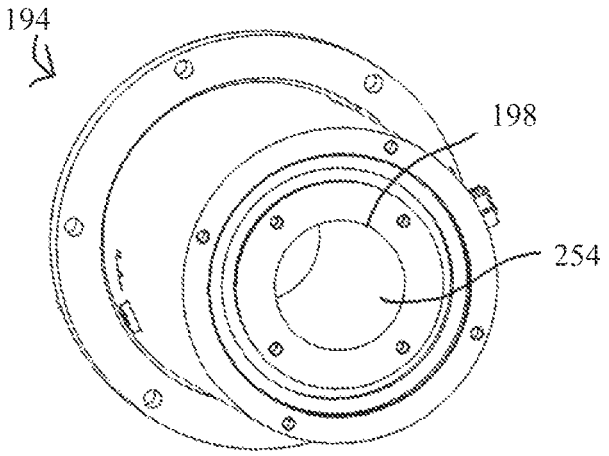
FIG. 20 is a top perspective view of the housing of FIG. 19.
Figure 21:
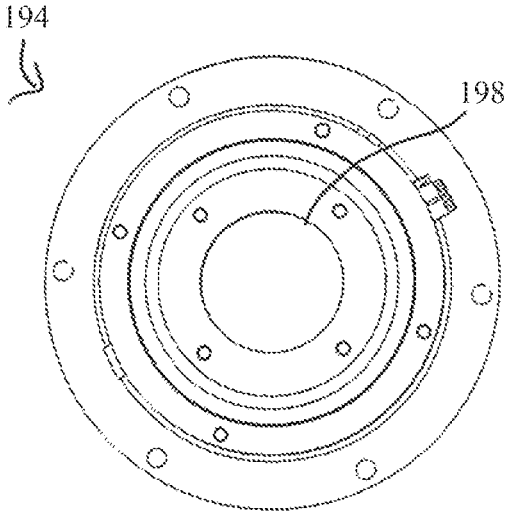
FIG. 21 is a top plan view of the housing of FIG. 19.
Figure 22:
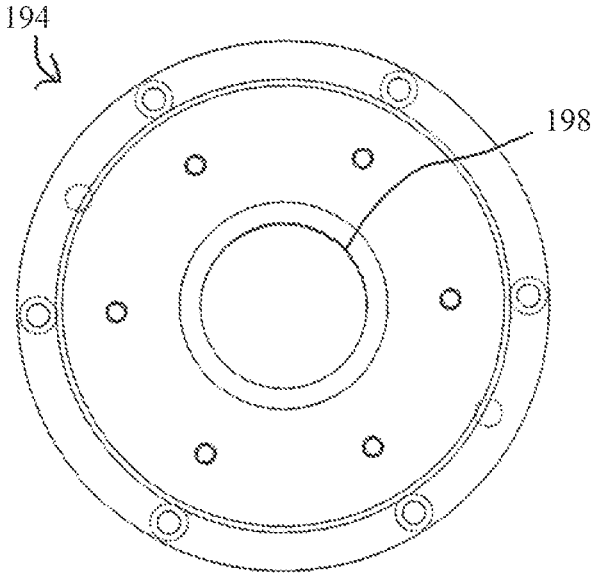
FIG. 22 is a bottom plan view of the housing of FIG. 19.
Figure 23:
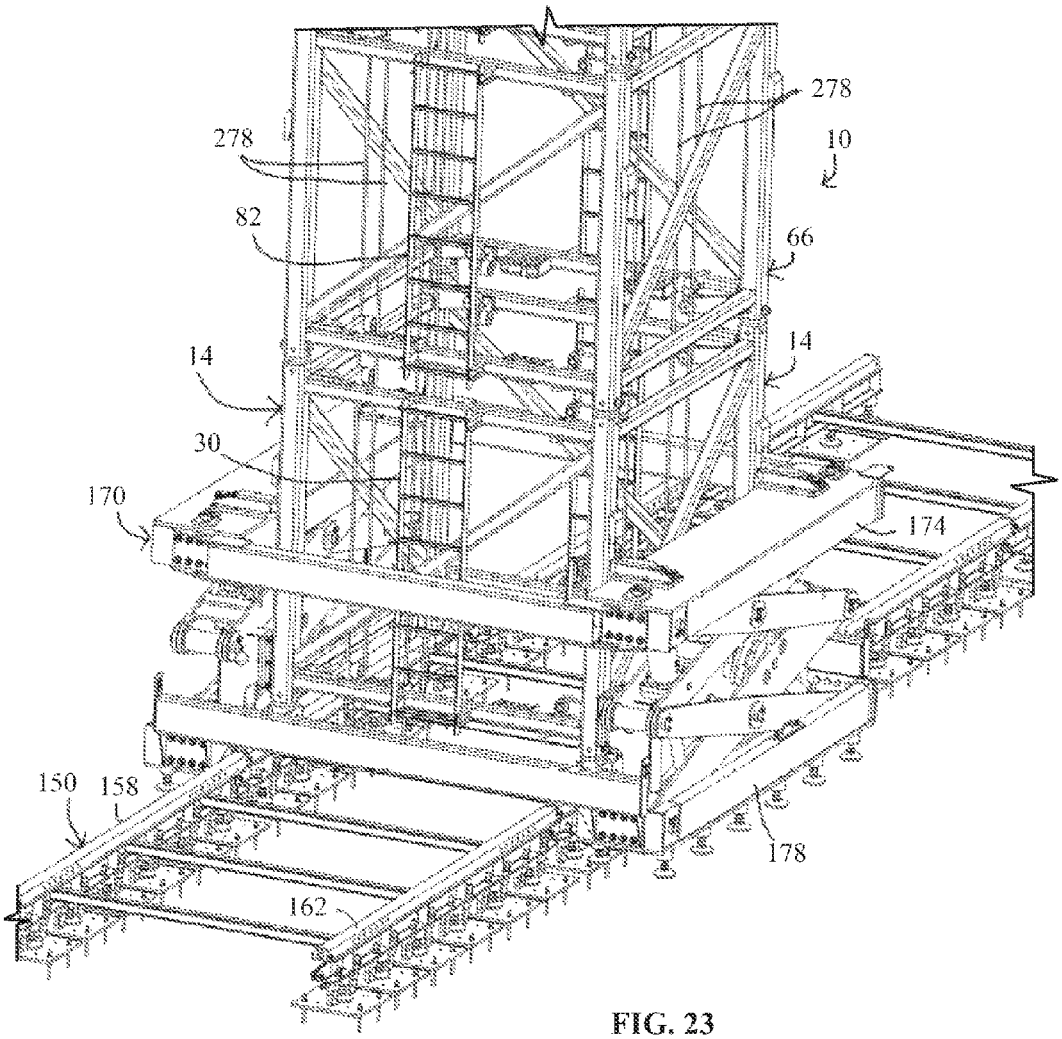
FIG. 23 is an enlarged, partial perspective view of the self-erecting jacking tower of FIG. 1.

With continued reference to FIGS. 16-18, the rod 202 includes a first end 234 and a second end 238 disposed opposite the first end 234. The second end 238 includes a coupling mechanism 242 for pivotally coupling the rod 202 to the scissors element 182. The coupling mechanism 242 is a fork-shaped member having a first arm 246 with a first aperture 248 and a second arm 250 with a second aperture 252.

With continued reference to FIGS. 16-20, the aperture 198 of the first housing 194 is defined by an inner surface 254 of the housing 194, and the rod 202 includes an outer surface 258. A diameter of the first aperture 198 is approximately equal to a diameter of the rod 202. If the hydraulic cylinders 186 fail, the scissors lift assembly 170 attempts to collapse, and the rod 202 attempts to slide through the aperture 198. However, the outer surface 258 of the rod 202 is configured to engage and wedge against the inner surface 254 of the first housing 194, thereby stopping downward movement of the top frame 174. This wedging action occurs because both the first housing 194 and the rod 202 are separately pivotally coupled to the a pair of scissors elements 182. As illustrated in FIGS. 13 and 14, downward movement of the top frame 174 causes pivoting of both the first housing 194 and rod 202. As the rod 202 tries to slide through the aperture 198, a wedging force applied by the outer surface of the rod against the inner surface of the housing is formed, the wedging force being directly proportional to a speed or acceleration at which the scissors lift is collapsing. When the wedging force is large enough, all relative movement between the top frame 174 and the bottom frame 178 is stopped. To remove the wedge force, the hydraulic cylinders 186 are activated again, and the top frame is pushed upward relative to the bottom frame 178. Only when the top frame 174 is moved down at a slow enough rate relative to the bottom frame 178 can the rod 202 slide through the aperture 198 without causing a wedging action.

With continued reference to FIG. 14, the lift assembly 170 also includes channels 262 formed in the bottom frame 178. The channels 262 facilitate a sliding motion of the scissor elements 182 as the top frame 174 is moved upward and downward relative to the bottom frame 178.

With reference to FIGS. 13 and 14, the lift assembly 170 also includes four shear pins 266. The shear pins 266 are located on the top frame 174. The shear pins 266 are movable from a first position, as illustrated for example in FIGS. 13 and 14, to a second position in which the shear pins 266 extend inwardly along the top frame 174 (i.e. toward one another). As described further herein, the shear pins 266 are used to temporarily engage the lower module assembly 14, middle module assemblies 66, and top module assembly 110, so as to raise and/or lower these assemblies as desired.

Figure 9:
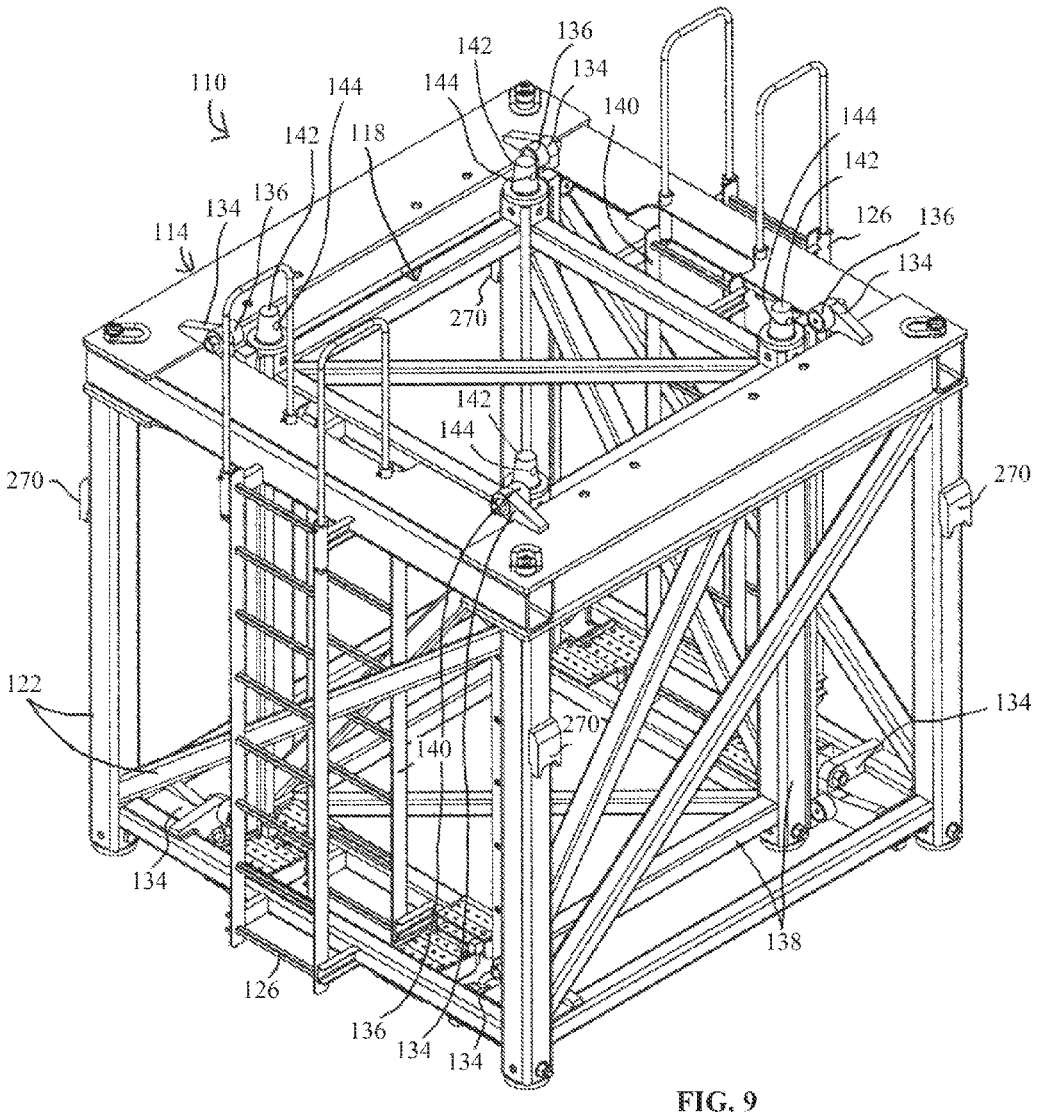
FIG. 9 is a top perspective view of a top module assembly of the self-erecting jacking tower of FIG. 1.
Figure 10:
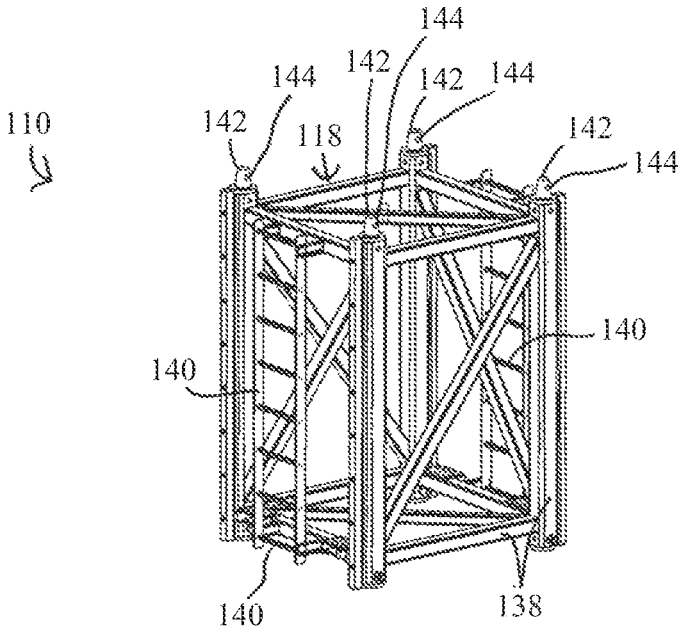
FIG. 10 is a top perspective exploded view of the top module assembly of FIG. 9, illustrating an outer frame and an inner frame of the top module assembly
Figure 10:
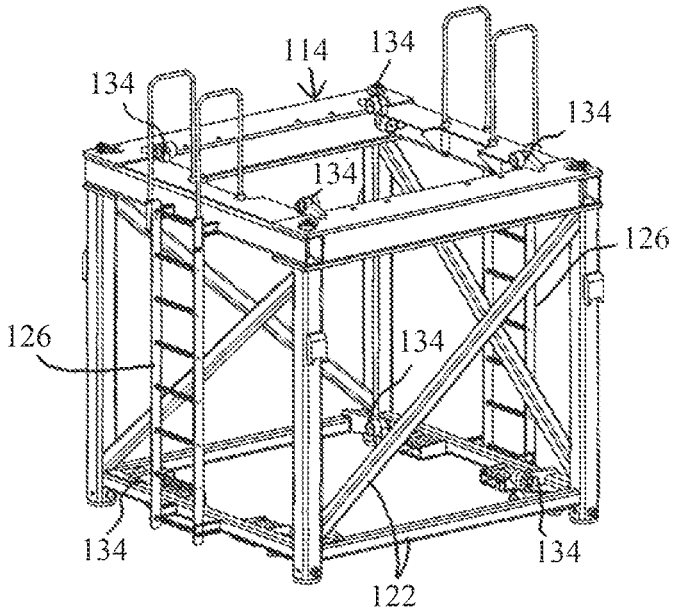

With reference to FIGS. 1-23, a method of self-erecting the jacking tower 10 includes placing the top module assembly 110 on the rail cart 154 and delivering the top module assembly 110 along the rail assembly 150 to the lift assembly 170. The lift assembly 170 is raised to a position as illustrated in FIG. 14 to allow the rail cart 154 and top module assembly 110 to be inserted underneath the top frame 174. With the top module assembly 110 inserted underneath the top frame 174, the scissors lift assembly 170 is lowered around the top module assembly 110. As illustrated in FIG. 9, the top module assembly 110 includes shear structures 270. With the lift assembly 170 lowered around the top module 174, the shear pins 266 on the lift assembly 170 are inserted beneath the shear structures 270 and engaged with the shear structures 270. The lift assembly 170 is then extended, such that the top frame 174 rises relative to the bottom frame 178, thereby engaging the shear pins 266 with the shear structures 270 and raising the top module assembly 110. The top module assembly 110 is raised to a level high enough so that another assembly (e.g., a middle module assembly 66) can be inserted beneath the top module assembly 110.

With continued reference to FIGS. 1-23, with the lift assembly 170 extended, and the top module assembly 110 raised, the rail cart 154 is moved away, and a middle module assembly 66 is placed on top of the rail cart 154. The rail cart 154 and middle module assembly 66 are then moved down the rail assembly 150 until the rail cart 154 and middle module assembly 66 are positioned directly below the top module assembly 110. The lift assembly 170 is then lowered, until the male mating components 86, 102 of the middle module assembly 66 are inserted into the female mating components 130, 146 of the top module assembly 110. Bolts are then passed through the apertures 88 and 132, as well as through the apertures 104 and 148, to further couple the top module assembly 110 to the middle module assembly 66.

With continued reference to FIGS. 1-23, the shear pins 266 are retracted, for example to positions as shown in FIG. 13, and the top frame 178 is lowered relative to the bottom frame 174. With the lift assembly 170 retracted, the shear pins 266 are extended out again, and the lift assembly 170 is extended. With reference to FIG. 6, the middle module assembly 66 includes shear structures 274. As the lift assembly 170 extends, the shear pins 266 are inserted below and engage the shear structures 274 on the middle module assembly 66. The lift assembly 170 is extended further, such that the shear pins 266 are engaged with the shear structures 274 and both the middle module assembly 66 and top module assembly 110 are raised, the top module assembly 110 remaining coupled to the middle module assembly 66. The middle module assembly 66 and top module assembly 110 are raised to a level high enough so that another assembly (e.g. another middle module assembly 66 or bottom module assembly 14) can be inserted beneath the middle module assembly 66.

With reference to FIG. 1-23, the illustrated construction includes three middle module assemblies 66. Thus, after the first middle module assembly 66 is inserted, two additional middle module assemblies 66 are inserted in a similar manner (i.e., by lowering the scissors lift assembly 170 about the middle module assemblies 66, engaging the shear pins 266 to the shear structures 274 on the middle module assemblies 66, and raising the partially constructed jacking tower 10 again). While the illustrated construction includes three middle module assemblies 66, other constructions include different numbers of middle module assemblies 66. In some constructions, no middle module assemblies 66 are used, and the top module assembly 110 is coupled directly to the bottom module assembly 14.

Figure 25:
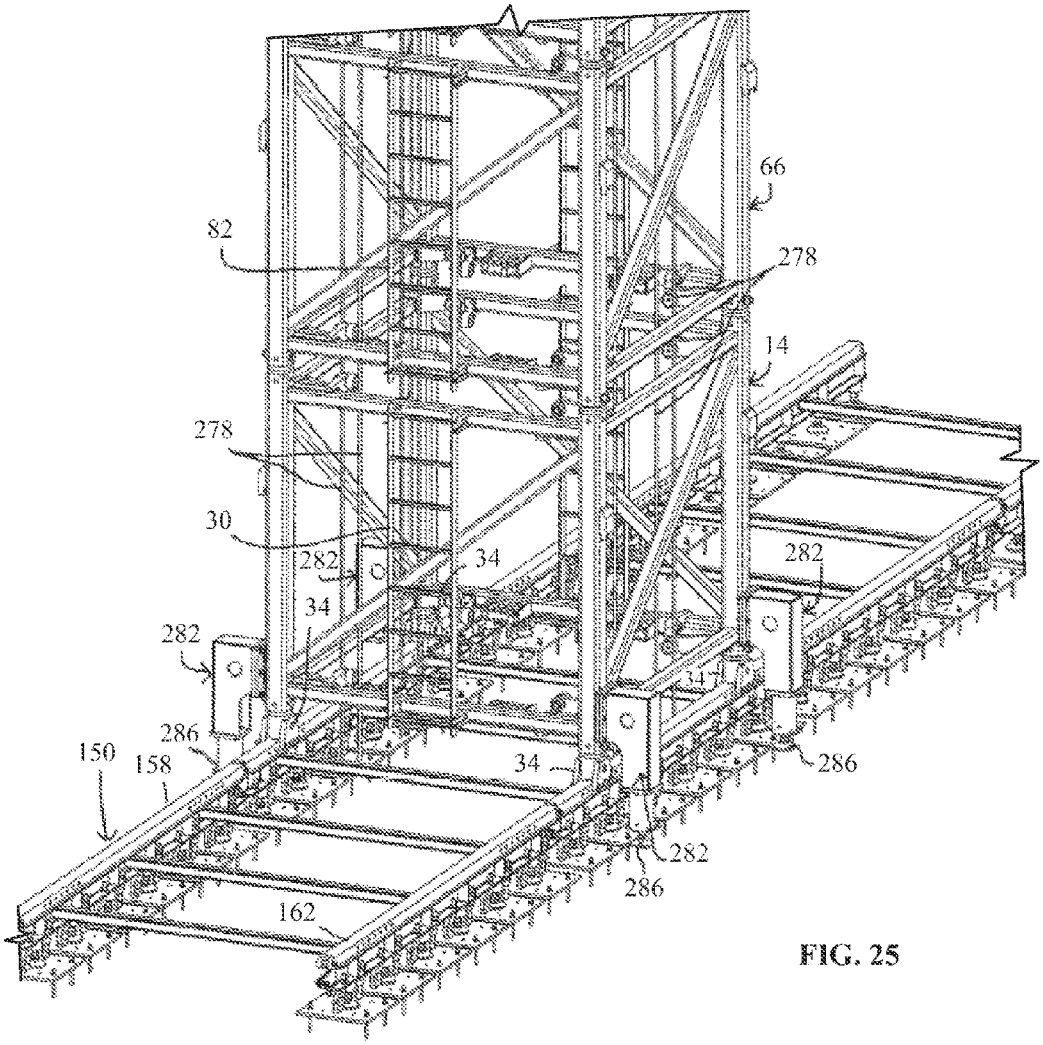
FIG. 25 is an enlarged, partial perspective view of the self-erecting jacking tower of FIG. 1, with the scissors lift assembly removed, and illustrating the tower outrigger of FIG. 24.

With continued reference to FIGS. 1-23, with the final middle module assembly coupled to the partially constructed jacking tower 10, the partially constructed jacking tower 10 is raised with the lift assembly 170, and the rail cart 154 is removed. The bottom module assembly 14 is then placed on top of the rail cart 154, and the rail cart 154 and bottom module assembly 14 are moved down the rail assembly 150 until the rail cart 154 and bottom module assembly 14 are positioned directly below the final middle module assembly 66. The lift assembly 170 is retracted, and the male mating components 38, 50 of the bottom module assembly 14 are inserted into the female mating components 90, 106 of the middle module assembly 66. Bolts are passed through apertures 40 and 92, and through apertures 52 and 108, thereby further coupling the middle module assembly 66 to the bottom module assembly 14. The bottom module assembly 14 is then coupled to the rail assembly 150 to provide support for the jacking tower 10. Specifically, and as illustrated in FIG. 25, the feet 34 are fastened to the rails 158, 162.

To disassemble the jacking tower 10, the steps of the method described above are reversed.

As described above, the inner frame 22 of the bottom module assembly 14 includes eight strand jacks 58. The strand jacks 58 are used to raise and lower the coupled inner frames 22, 74, 118 relative to the coupled outer frames 18, 70, 114 as desired to obtain different overall heights for the jacking tower 10. Specifically, and with reference to FIGS. 1, 23, and 25, the strand jacks 58 are coupled to cables 278. Each of the cables 278 are coupled at one end to the outer frame 114 of the top module 110. The cables 278 extend through the strand jacks 58. The strand jacks 58 are built around hydraulic cylinders that cycle back and forth, pulling a length of the cable 278 through a center cavity of the strand jack 58 using two collets (not shown). The first collet clamps onto the cable 278 so the hydraulic cylinder can pull it along. At the end of the stroke, the second collet clamps the cable 278 and the first collet releases. The cable 278 is held firmly and safely in place as the cylinder retracts to a position allowing the strand jack 58 to repeat the process. The strand jacks 58 climb up the cables 278, thereby bringing the inner frame 22, and coupled inner frames 74, 118, with them. Reversing the operation of the strand jacks 58 lowers the inner frames 22, 74, 118.

Each of the cables 278 includes a straight central wire or rod (not shown) and six other wires or rods wrapped helically around the central wire or rod. The cables 278 are compacted or swagged to provide greater surface areas along outer diameters of the cables 278. This enables the collets of the strand jacks 58 to better grip the cables 278 and minimizes the possibility of peening the cables 278.

Figure 24:
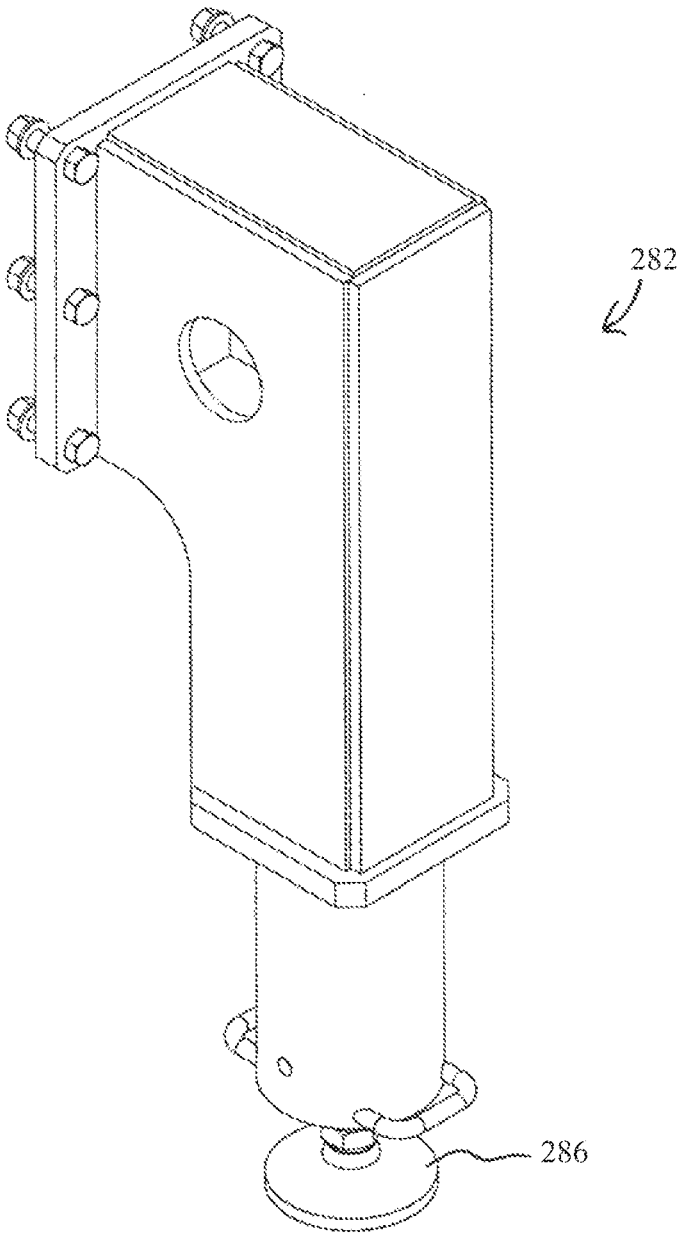
FIG. 24 is a perspective view of a tower outrigger for use with the self-erecting jacking tower of FIG. 1.

With reference to FIGS. 24 and 25, the jacking tower 10 also includes tower outriggers 282. The outriggers 282 are coupled to the bottom module assembly 14, and include hydraulic cylinders 286 that contact a surface (e.g., the floor of an industrial, commercial, and/or nuclear power plant). The hydraulic cylinders 286 allow the fully erected jacking tower 10 to be safely lifted for the rail cart 154 to be brought underneath, thereby allowing the jacking tower 10 to be placed on the rail cart 154 and relocated along the rail assembly 150, if desired.

Figure 26:
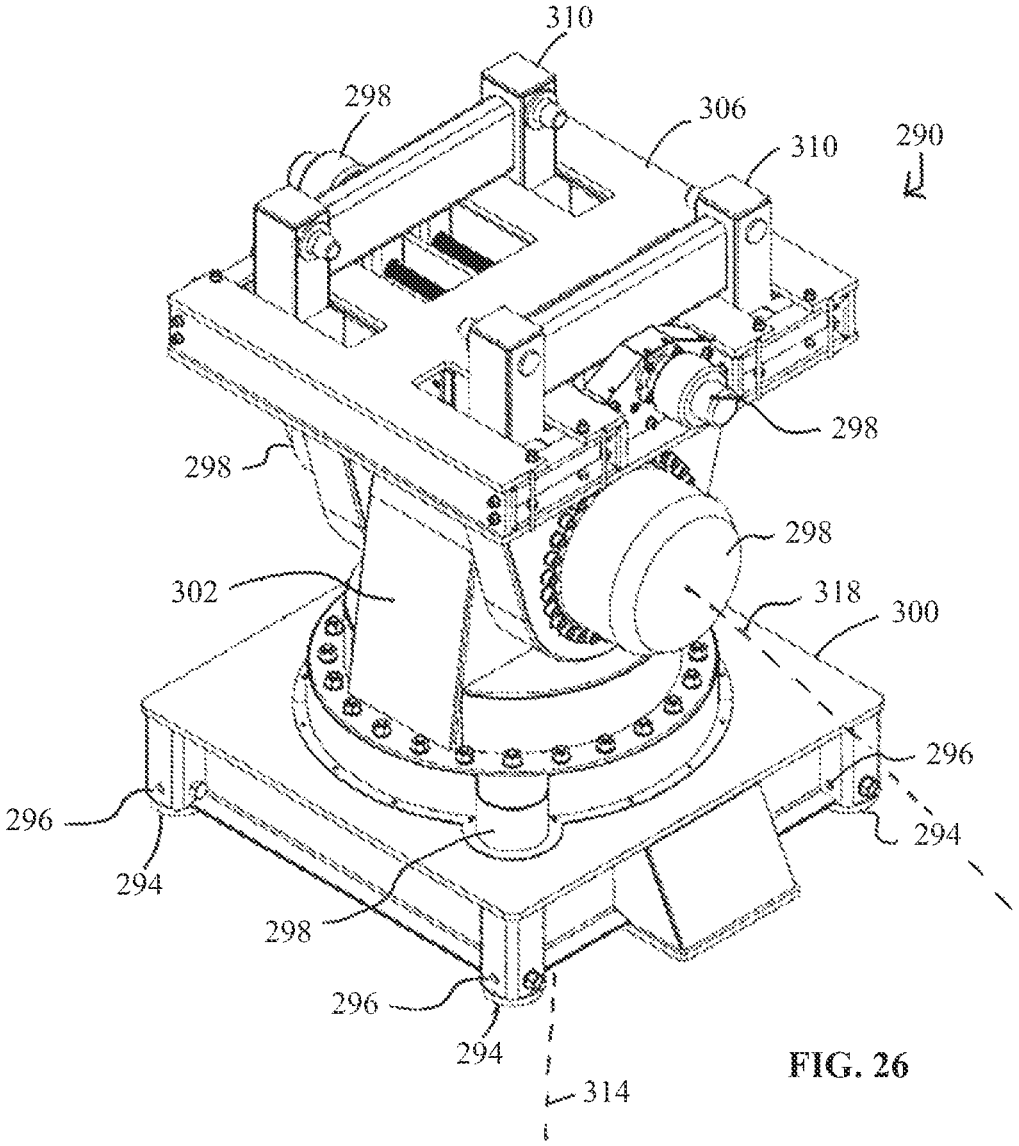
FIG. 26 is a perspective view of a head assembly of the self-erecting jacking tower of FIG. 1.

With reference to FIG. 26, the jacking tower 10 also includes a head assembly 290. The head assembly 290 is configured to be coupled to the inner frame 118 of the top module assembly 110. Specifically, the head assembly 290 includes female mating components 294 in the form of tapered sockets, with apertures 296. To couple the head assembly 290 to the inner frame 118, the female mating components 294 are aligned and lowered onto the male mating components 142 of the inner frame 118, and bolts are passed through apertures 296, 144. The head assembly 290 is coupled to the inner frame 118 prior to the method of erecting the jacking tower 10 described above.

The head assembly 290 includes hydraulically powered motors 298 that provide the head assembly 290 with multiple degrees of freedom. The head assembly 290 includes a base portion 300, a rotatable middle portion 302, and a top portion 306. The top portion 306 includes clamping jaws 310. The rotatable middle portion 302 is coupled to the top portion 306, such that the middle portion 302 and top portion 306 are rotatable 360 degrees about a first axis 314. Additionally, a section of the middle portion 302 is able to partially rotate about a second axis 318, which is substantially perpendicular to the first axis 214.

Figure 27:
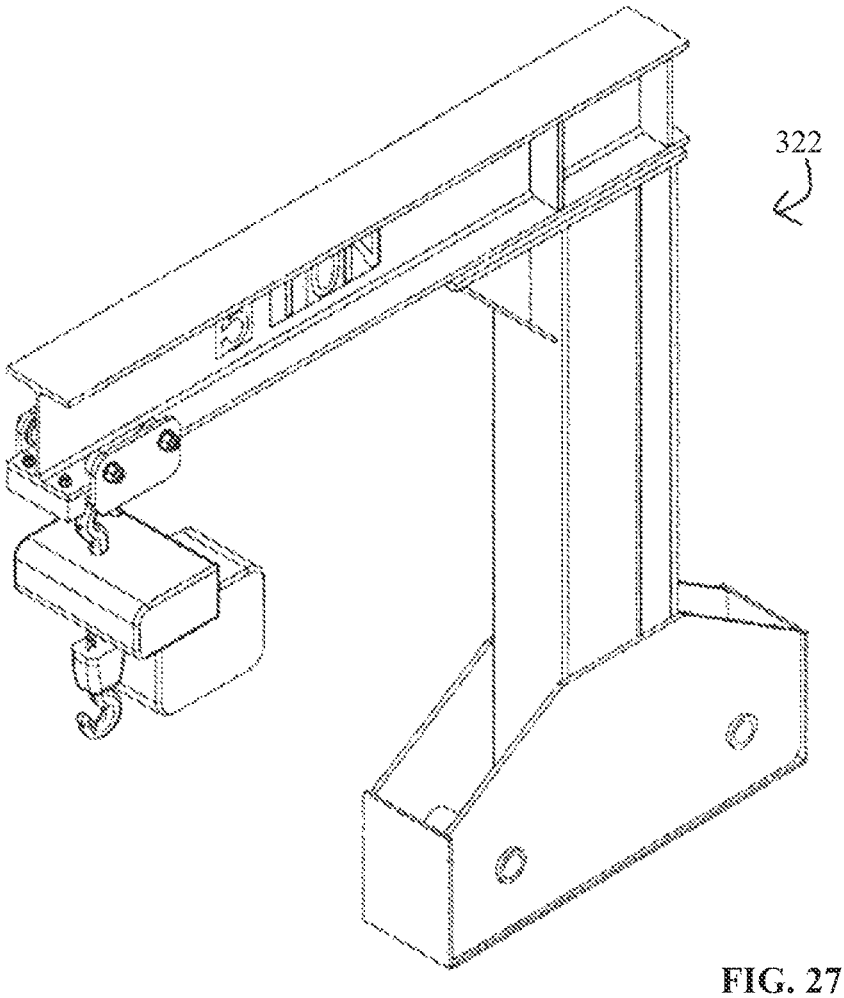
FIG. 27 is a perspective view of a tower jib crane assembly for use with the self-erecting jacking tower of FIG. 1.
Figure 28:
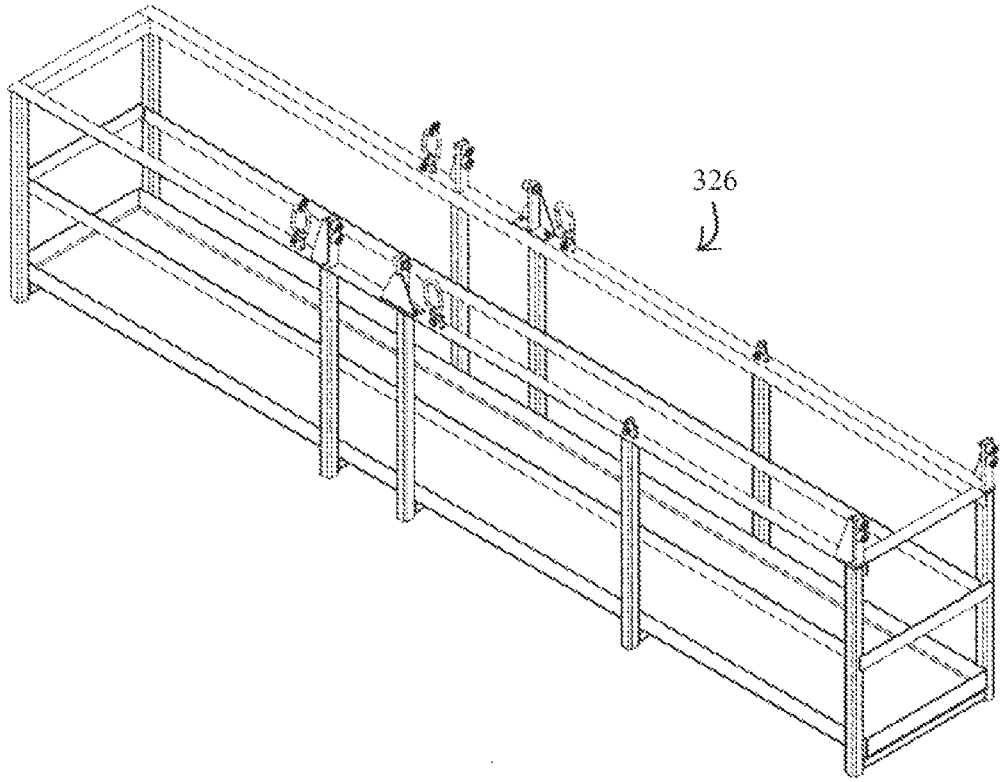
FIG. 28 is a perspective view of a hanging platform for use with the self-erecting jacking tower of FIG. 1

With reference to FIGS. 27 and 28, the head assembly 290 is used to grab, restrain, and/or move various components, including but not limited to a tower jib crane assembly 322 as illustrated in FIG. 27, and a hanging platform 326 as illustrated in FIG. 28.

The tower jib crane assembly 322 couples to the head assembly 290 and lifts smaller crane components for installation in an industrial, commercial, and/or nuclear power plant (or other location). The tower jib crane assembly 322 is able to lift directly from a floor, without requiring another crane to position its loads.

The hanging platform 326 is an ancillary device to aid in the installation of a crane and a crane's various components. The hanging platform 326 is coupled to the jacking tower 10 via the head assembly 290 and is lifted into position where it is then installed on the bottom flanges of a crane girder (not shown). The hanging platform 326 uses rollers (not shown) that allow it to travel the length of a bottom of the crane.

Figure 29:
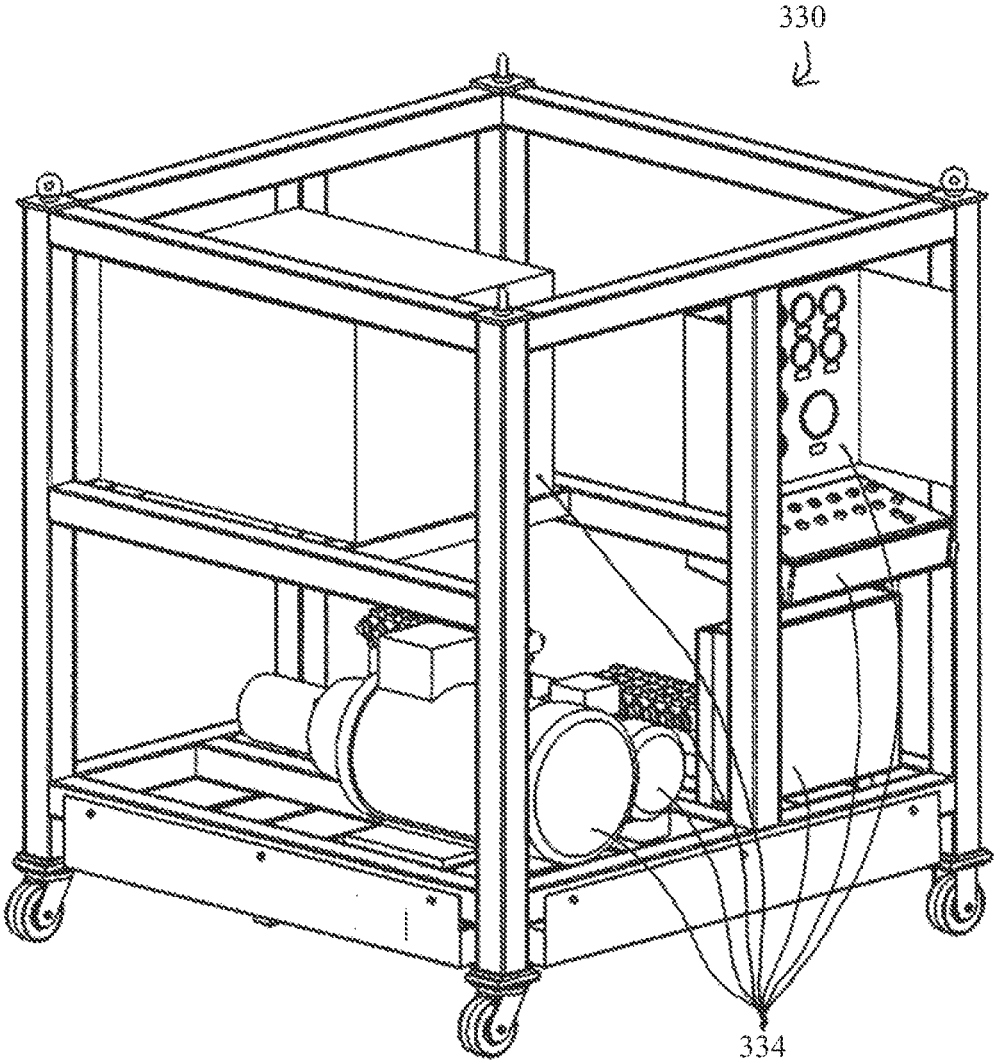
FIG. 29 is a perspective view of a hydraulic power unit for use with the self-erected jacking tower of FIG. 1.

With reference to FIG. 29, the jacking tower 10 also includes an associated hydraulic power unit 330. The hydraulic unit 330 is used to provide motive power for components of the jacking tower 10, including the strand jacks 58, the hydraulic cylinders 186 on the scissors lift assembly 170, the hydraulic cylinders 286 on the tower outriggers 282, and the hydraulic motors 298 on the head assembly 290. The hydraulic power unit 330 supplies hydraulic pressure and flow by incorporating equipment 334 including an electric motor driving a hydraulic pump, a hydraulic oil reservoir, oil filters, a solenoid valve bank, a control panel for activating the various functions, a data panel to monitor the various functions, and other miscellaneous equipment.

Although the invention has been described in detail with reference to certain preferred embodiments, variations and modifications exist within the scope and spirit of one or more independent aspects of the invention as described.

What is claimed is:

1. A method of self-erecting a jacking tower comprising:

delivering a top module assembly to a lift assembly, the top module assembly including an outer frame and an inner frame movable within the outer frame;

raising the top module assembly with the lift assembly;

delivering a middle module assembly below the raised top module assembly, the middle module assembly including an outer frame and an inner frame movable within the corresponding outer frame;

coupling the top module assembly to the middle module assembly;

raising the middle module assembly and top module assembly together with the lift assembly;

delivering a bottom module assembly below the middle module assembly and the top module assembly, the bottom module assembly including an outer frame and an inner frame movable within the outer frame;

coupling the middle module assembly to the bottom module assembly; and raising the inner frame portions of the bottom module assembly, middle module assembly, and top module assembly together relative to the outer frame portions of the bottom module assembly, middle module assembly, and top module assembly;

wherein the step of raising the inner frame portions includes raising the inner frame portions with a plurality of strand jacks coupled to the inner frame portion of the bottom module assembly and cables coupled to the strand jacks and to the outer frame of the top module assembly.

2. The method of claim 1, wherein the step of delivering the top module assembly includes moving the top module assembly along a rail assembly, the lift assembly positioned over the rail assembly.

3. The method of claim 1, further comprising engaging the lift assembly with the top module assembly by inserting shear pins on the lift assembly beneath shear structures on the top module assembly.

4. The method of claim 1, wherein the lift assembly includes hydraulic cylinders for lifting and lowering the scissors lift assembly.

5. The method of claim 1, wherein the step of coupling the top module assembly to the middle module assembly includes inserting a plurality of tapered pins on the middle module assembly into a plurality of tapered openings on the top module assembly.

6. The method of claim 1, further comprising coupling a head assembly to the inner frame of the top module assembly.

7. The method of claim 1, further comprising delivering a plurality of middle module assemblies below the raised top module assembly, and stacking the plurality of middle module assemblies and coupling to the top module assembly and bottom module assembly.

* * * * *